US007316149B2

(12) United States Patent
Baba et al.

(10) Patent No.: US 7,316,149 B2
(45) Date of Patent: Jan. 8, 2008

(54) INTER-PRESSING-MACHINE WORK TRANSFER DEVICE

(75) Inventors: Kiyokazu Baba, Komatsu (JP); Kazuhiko Shiroza, Komatsu (JP); Takashi Moriyasu, Komatsu (JP); Shuuji Mizuguchi, Komatsu (JP)

(73) Assignee: Komatsu Ltd., Tokyo (JP)

( * ) Notice: Subject to any disclaimer, the term of this patent is extended or adjusted under 35 U.S.C. 154(b) by 180 days.

(21) Appl. No.: 11/042,894

(22) Filed: Jan. 25, 2005

(65) Prior Publication Data

US 2005/0166659 A1 Aug. 4, 2005

(30) Foreign Application Priority Data

Jan. 30, 2004 (JP) ..... 2004-022712
Mar. 8, 2004 (JP) ..... 2004-063825

(51) Int. Cl.
*B21D 43/05* (2006.01)

(52) U.S. Cl. ..... 72/405.09; 72/405.1; 198/621.1; 414/752.1

(58) Field of Classification Search ..... 72/405.01, 72/405.1, 405.09; 414/752.1, 751.1, 737, 414/744.8; 198/621.1
See application file for complete search history.

(56) References Cited

U.S. PATENT DOCUMENTS 1,766,573 A * 6/1930 Westin ..... 414/733
4,400,984 A * 8/1983 Ronbeck ..... 74/103
4,585,389 A * 4/1986 Watanabe et al. ..... 198/750.12
5,140,839 A * 8/1992 Bruns ..... 72/405.1
5,452,981 A * 9/1995 Crorey et al. ..... 198/468.6
6,712,198 B2 * 3/2004 Harsch et al. ..... 198/750.11
6,715,981 B1 * 4/2004 Harsch et al. ..... 414/752.1
6,786,857 B2 * 9/2004 Harsch et al. ..... 483/28
7,159,438 B2 * 1/2007 Lauke et al. ..... 72/405.11

FOREIGN PATENT DOCUMENTS

JP 10-137997 5/1998
JP 2002-307116 A 10/2002
JP 2003-200231 A 7/2003

* cited by examiner

*Primary Examiner*—Daniel C Crane
(74) *Attorney, Agent, or Firm*—Frishauf, Holtz, Goodman & Chick, P.C.

(57) ABSTRACT

The present invention provides a work transfer device for transferring a work between adjoining pressing machines including a work holder (30) for holding a work W, a carrier (23) provided between the adjoining pressing machines (10) and capable of being linearly moved in a direction orthogonal to a work transfer direction with a driving mechanism, and a swinging body (71) with a swinging center shaft thereof provided on this carrier (23) and capable of being driven for swinging by a swinging mechanism (84) along the work transfer direction, and the work holder (30) is provided in the swinging body (71). Because of this configuration, it is not necessary to secure a trajectory for swiveling like in a robot arm type of transfer device, not to extend a lift beam up to a position close to a slide like in the feeder type of transfer device, so that it is not necessary to widen a clearance between uprights (12) and a tandem press (1) can be size-reduced as a whole.

13 Claims, 28 Drawing Sheets

INTER-PRESSING-MACHINE WORK TRANSFER DEVICE

BACKGROUND OF THE INVENTION

1. Field of the Invention

The present invention relates to an inter-pressing-machine work transfer device.

2. Description of Related Art

As a work transfer device for transferring a machining material (work) between a plurality of pressing machines sequentially arranged (tandem press), there have been known robot arm type and feeder type transfer devices.

The robot arm type transfer device includes an arm turning around a pivot provided in the upright state at an intermediate position between adjoining pressing machines, and a work holder attached to a tip of the arm. With the transfer device as described above, a work can be transferred from one press to another press, when the work is held by one press, by turning the arm by about 180 degrees around the pivot (Refer to Japanese Patent Laid-Open Publication No. HEI 10-137997).

The feeder type transfer device is used in a transfer press, and includes a lift beam provided in parallel to the work transfer direction (feed direction), a carrier supported by this lift beam, and a linear motor as a feed driving unit for driving the carrier along the lift beam. With the transfer device, in the state where the work is held by a work holder supported between a pair of carriers, when the carriers are driven in the feed direction, the work can be transferred to the next machining stage (Refer to Japanese Patent Laid-Open Publication No. 2002-307116).

A transfer device used in a transfer press is described above, but the same structure can be applied also to a transfer device in a tandem press.

However, in the case of the robot arm type transfer device described above, a work is carried by turning the arm around the pivot, some specific measures are required such as widening a distance between uprights according to turning trajectories of the arm and the work.

Further in the case of the feeder type transfer device described above, interference between the lift beam arranged along the work transfer direction and a slide of a pressing machine must be prevented, namely a space for arranging a lift beam between the slide of a pressing machine and the upright is required.

Because of the features, in any of the conventional work transfer devices as described above, any upright must be provided in the upright state at a position outer from a center of the press, and size of the entire press as a line such as a tandem press including a plurality of pressing machines will become disadvantageously larger.

Recently pressing machines already having been installed are often retrofitted, and there are the strong needs for development of a work transfer device which can advantageously be used in retrofitting the existing pressing machines. Especially in a device for pressing already having been installed, sometimes a distance between the adjoining pressing machines is large. When it is tried to respond to the situation where the distance between pressing machines is large, the problems as described below will be encountered.

The feed type transfer device as described above can hardly be applied, because of the specific structure, in the case where the distance between adjoining pressing machines is large.

In a case of the robot arm type work transfer device described above, it is possible to take countermeasures in retrofitting by prolonging the length of the arm between joints in proportion to a distance between adjoining pressing machines and also by raising a power of a drive unit used in each joint section. However, when an arm length of a robot arm type work transfer device is made larger or an output power of a driving unit is raised, the size of the work transfer device as a whole becomes accumulatively larger, which is disadvantageous. Further when a distance between adjoining pressing machines is small, it is extremely difficult to set a trajectory of a work evading interference with the upright or the like, which is also disadvantageous.

There has been known a work transfer device based on the loader/unloader system as a work transfer device capable of accommodating even the situation in which a distance between adjoining pressing machines is large.

In the work transfer device based on the loader/unloader system, a loader and an unloader each having the link structure are provided in the upstream side face and in the downstream side face of each pressing machine respectively, and a shuttle chassis is provided between the unloader in the upstream side and the loader in the downstream side, so that a work can be carried out from and into a main body of the pressing machine by the unloader and the loader respectively and the work is transferred to the next machining step with the shuttle chassis.

Even with the work transfer device based on the loader/unloader system as described above, when a distance between adjoining pressing machines is large, it is necessary to provide the shuttle chassis between the adjoining pressing machines in the spanning state, so that size of the device as a whole becomes larger and a large space is required for installation of the device. Further a work is delivered to or from the shuttle chassis, so that a carriage mistake easily occurs.

As described above, the size inevitably becomes larger in configuration of any type of work transfer device, and therefore it is difficult to raise the handling speed for improving the production efficiency.

To solve the problems as described above, the present applicant has proposed a work transfer device having a relatively slim configuration and allowing a higher work transfer speed (Refer to Japanese Patent Laid-Open Publication No. 2003-200231).

In this work transfer device 300, as shown in FIG. 28A and FIG. 28B, a lift beam 301 is provided in parallel to the work transfer direction T, and a carrier 302 and a sub carrier 303 each movable along the longitudinal direction of the lift beam 301 are provided, and further the work transfer device 300 includes a cross bar 305 having a vacuum cup 304 as a work holder between a pair of sub carriers 303 adjoining to each other respectively at the left and right sides.

In this work transfer device 300, the vacuum cup 304 is moved up and down via the carrier 302, sub carrier 303, and cross bar 305 by driving the lift beam 301 up and down with a lift shaft servo motor 306. Further the carrier 302 is moved along the longitudinal direction of the lift beam 301 when driven by a linear motor (not shown) provided, between the lift beam 301 and the carrier 302, and further by offsetting the sub carrier 303 in the moving direction of the carrier 302 when driven by a linear motor (not shown) provided between the carrier 302 and the sub carrier 303, the cross bar 305 and the vacuum cup 304 is moved in the work transfer direction T. Thus, by controlling positions of the two orthogonal driving shafts for movements in the vertical direction and/or in the work transfer direction T, a trajectory of movement of the vacuum cup 304, namely a transfer trajectory of a work W can be controlled.

However, in the work transfer device 300 as described above, rigidity of the lift beam 301 must be raised for insuring precision in positioning, and therefore weight of the lift beam 301 inevitably increases. Further for moving the cross bar 305 up and down, it is necessary to move the entire lift beam 301 up and down.

Because of the features, also in the work transfer device 300, size of the servo motor 306 becomes larger, so that the entire device becomes larger, which inevitably causes cost increase. When a small size servo motor is employed as the servo motor 306 to evade the problems as described above, it is difficult to raise the work transfer speed, so that the production efficiency can not be improved to a desired level, which is disadvantageous.

Further as an end section of the lift beam 301 is provided in a carrying-in/carrying-out area of a die, so that, when the die is exchanged with a new one, the operation for exchanging the die must be carried out after the lift beam 301 is moved up to outside of the carrying-in/carrying-out area, which disadvantageously causes a drop of the production yield.

As described above, there has been the strong need for development of a work transfer device for transferring a work between pressing machines allowing size reduction of the pressing device and the pressing line even when a distance between pressing machines is large like in the conventional type of pressing device.

SUMMARY OF THE INVENTION

A main object of the present invention is to provide a work transfer device for transferring a work between pressing machines allowing size reduction of a pressing device as well as of a pressing line, and the present invention employs the configuration as described below for achieving the object described above.

The present invention provides a work transfer device for transferring a work between adjoining pressing machines, and the work transfer device according to an aspect of the present invention includes a work holder for holding the work, a carrier provided between the adjoining pressing machines and linearly moved in a direction orthogonal to a work transfer direction with a driving mechanism, and a swinging body with a swinging center shaft provided in the carrier and capable of being driven for swinging by a swinging mechanism along the work transfer direction, in which the work holder is provided in the swinging body.

In the invention as described above, in the work transfer device for feeding a work from one pressing machine to another pressing machine along the work transfer direction, as the swinging center shaft of the swinging body is linearly moved together with the carrier in the direction orthogonal to the work transfer direction, the work transfer device can be installed in a narrow space against the work transfer direction. Because of this feature, when the feed mechanism is provided between adjoining pressing machines, the clearance between uprights opposing to each other may be narrow, which enables shortening the entire pressing line. In addition, between adjoining uprights, the work can be directly transferred from one press machining position to another pressing machining position. Further it is not necessary to secure a swiveling trajectory for a robot arm, or to provide the lift beam at a position inner from the upright, so that the clearance between adjoining uprights in relation to the work transfer direction can be made smaller, which enables size reduction of the pressing device as a whole.

Further the present invention may be applied to reformation (retrofitting) of a pressing machines already having been installed in which a clearance between uprights can not be changed.

In the present invention, a tilt mechanism may preferably be provided for driving the work holder for rotation around a shaft parallel to the swinging center shaft.

With the invention as described above, as the tilt mechanism is provided, a work is tilted in the vertical direction by the tilt mechanism to compensate an inclination of the work inevitably generated in association with the swinging movement of the swinging body. Because of this configuration, as the work can be maintained in the horizontal posture, the operations for transferring a work in and out from a position for press working can be performed more smoothly and more accurately as compared to those in the conventional technology.

Further it is possible to intentionally tilt a work during transportation thereof for placing the work on a lower die in the next step, which allows a higher degree of freedom in die designing.

The work transfer device-may preferably include a work holder for holding a work, a first link with the work holder rotatably attached to one end side thereof, a guide section for pivotably supporting another end of this first link and linearly guiding the other end of the first link along a direction orthogonal to the work transfer direction, a second link with one end side thereof rotatably connected to a section between two ends of the first link, a supporting point for rotatably supporting the other end side of this second link, and a driving unit for driving at least one of the first link and the second link, in which the one end side of the first link moves along the work transfer direction when the first link and the second link are driven and swung by the driving unit.

With the present invention as described above, as the other end of the first link in the feed mechanism for feeding a work along the work transfer direction from one side of a pressing machine to the other side thereof linearly moves along the direction orthogonal to the work transfer direction, the feed mechanism can be installed in a narrow space against the work transfer direction. Therefore, when the feed mechanism is provided between adjoining pressing machines, a clearance between uprights is small, so that the length of the pressing line as a whole can be made smaller. In addition, a work can directly be transferred from one press machining position to another press machining position between adjoining pressing machines. Further it is not necessary to secure a trajectory for swiveling or the robot arm, also a lift beam is not necessary to be provided at inner side of the uprights, so that a clearance between adjoining uprights in the horizontal direction against the work transfer direction can be made smaller, so that size reduction of the entire pressing device is possible.

Further the present invention may be applied to reformation (retrofitting) of a pressing machine already having been installed in which the clearance between uprights can not be changed.

In the present invention, when either one or both of the first link and the second link are driven by the driving unit, the first link and the second link swing, and one end side of the first link and the work holder rotatably attached to the end of the first link move along the work transfer direction. Namely the work held by the work holder is transferred along the feed direction. Therefore, as a work can be transferred via the feed mechanism including the first and second links supported between uprights and the like, it is not necessary to provide the driving unit at a position near the slide, and the driving unit can easily be checked and serviced.

In the feeder type transfer device, as the lift beam is divided for each space between a pair of adjoining pressing machines, a driving power source (such as, for instance, a linear motor in the feeder type work transfer device based on the conventional technology as described above) is provided in a carrier driven in the feed direction. Because of this configuration, weight of the carrier itself becomes disadvantageously larger. Further when interference between the work transfer device and the die should occur, the damage may affect even the driving power source. However, in the present invention, as a heavy matter is not provided in one end side of the first link which moves in the feed direction, load in the driving operation is reduced, which enables energy saving. Further even when interference between the work transfer device and the die should occur, the damage does not affect the driving power source, so that the time required for restoring the pressing system is short.

In the present invention, the distance between the two end shafts of the second link may preferably be a half of that between the two end shafts of the first link, and preferably one end of the second link may be connected to a center between the two ends of the first link, and the other end of the second link is positioned on an extension of a straight line on which the other end of the first link moves.

In the invention as described above, as the distance between the two end shafts of the second link is a half of that between the two end shafts of the first link with one end of the second link connected to a center between the two end shafts of the first link and further the other end of the second link is positioned on an extension of a straight line on which the other end of the first link moves, the so-called Scott-Russel mechanism is formed with the first and second links. With the mechanism as described above, when the first link or the second link is driven by the driving unit, one end of the first link is linearly moved along the direction orthogonal to the moving direction of the other end of the first link guided by the guiding section, namely in the direction parallel to the work transfer direction. Therefore also the work holder attached to the one end of the first link linearly moves likewise, so that an area for moving trajectory of the work can be minimized with further size reduction of the pressing machine enabled. Further the work transfer distance is minimized because of the linear movement so that the transfer efficiency is improved.

In the present invention, the driving unit may preferably include a linear motor provided in the guide section.

In the present invention as described above, when the other end side of the first link guided by the guide section is linearly driven by the linear motor, the one end side of the first link moves along the work transfer direction. Therefore, work transfer can be carried out at a higher speed with a higher precision as compared to the driving mechanism converting a rotating movement to a linear movement using the general type of electric motor.

In the present invention, the driving unit may preferably include a rotation driving unit for rotating the second link around the supporting point in the other end side of the second link.

In the present invention as described above, various types of servo motors each with high versatility may be employed as the rotation driving unit for rotating the second link around the supporting point as a center, so that the production cost of the transfer device can be suppressed. Further as rotation of the second link is driven around the supporting point in the other end side of the second link as a center, it is not required to provide any driving unit in the one end side of the second link or the first link which is a movable component when a work is transferred, so that the structure of the movable component can be simplified with the weight reduced, so that a load for driving is further reduced.

In the present invention, there may preferably be provided a lift driving unit for moving up and down the supporting point in the other end side of the second link.

In the invention as described above, the supporting point is moved up and down by the lift driving unit, so that the lift driving unit is not positioned in an area where interference with the slide (or the upper die) may occur, and therefore even when interference between the work transfer device and the slide (or the upper die) should occur, it is possible to prevent the lift driving unit itself from being directly affected by the damage.

In the present invention, there may preferably be provided a biasing section for biasing the first link or the second link in a prespecified direction so that the one end of the first link moves off from the dead point when one end of the first link comes to a dead point positioned on a straight line connecting the other end of the first link to the other end of the second link.

In the invention as described above, by biasing the first link with the biasing section so that one end thereof passes through the dead point and moves in a correct direction, it is possible to control swinging of the first link more correctly, so that the work transfer can be performed with higher precision.

In the present invention, the biasing section may preferably include an actuator for pushing and pulling a prespecified position between the two end shafts of the second link.

In the present invention as described above, a cylinder type actuator which can prolong or shorten the length by driving a piston with a hydraulic pressure or an air pressure, or that using an electric motor for mechanically converting rotation thereof to a linear movement may be employed. Further, by pushing or pulling a prespecified position between two end shafts of the second link with the actuator, swinging of the first link with the one end of the second link connected thereto can be controlled correctly.

In the present invention, there may preferably be provided a lift driving unit for moving the work up and down in the work holder.

In the present invention as described above, the lift driving unit is not always required to be provided in the feed mechanism, so that the structure of the feed mechanism can be simplified.

In the present invention, the work transfer device may preferably includes a work holder for holding the work, a support member provided between the adjoining pressing machines, a lift carrier mounted on this support member and moved up and down by a lifting mechanism, and a swinging body with a swinging center shaft provided on this lift carrier and driven for swinging along the work transfer direction by a swinging mechanism, in which the swinging body may preferably be provided in the work holder.

In the present invention as described above, a motion of the work holder is set so that a work is carried out from a press machining position in the previous step and then is carried out to a press machining position in the next step by controlling up/down movement of the lift carrier caused by the lifting mechanism and swinging movement of the swinging body caused by the swinging mechanism. With the present invention, as it is possible to set weight of movable bodies moved by the lifting mechanism and the swinging mechanism (inertial loads) to smaller values respectively, and therefore the production cost can be reduced by downsizing and simplifying the device configuration, and also to improve the production efficiency by raising the work transfer speed.

Further motions of the work holder can freely be set by controlling movement thereof with the lifting mechanism and the swinging mechanism respectively. Especially, motions of the work holder can be set in a space between the slide and a bolster so that, when a work is carried into or out from a press machining position, the work holder is moved towards the press machining position by allowing intrusion of only the swinging body and also by preventing the lifting mechanism and the swinging mechanism from coming into the space with interference with a die or the like suppressed. Because of this configuration, it is not required, for instance, to excessively widen a clearance between uprights (front opening dimension) for providing a space for allowing intrusion of the lifting mechanism and swinging mechanism between right and left ends of the slide and an inner side face of an upright, and therefore the present invention can provide a work transfer device capable of being advantageously applied to reformation (retrofitting) of a pressing machine already having been installed in which the clearance between uprights can not be changed. On the other hand, when the work transfer device according to the present invention is applied to a pressing machine newly installed, a main body of the newly installed pressing machine can be designed compact, which advantageously allows reduction of the initial cost.

Further, as a swinging center shaft of the swinging body moves up and down together with the lift carrier, the work holder can be guided into a space between the slide (or the upper die) and the bolster (or the lower die) during the upward movement from a lower position of the slide as compared to the case in which the swinging center shaft is fixed. Because of this feature, there is not so strict restriction over the work transfer time, so that the productivity can be raised further.

In the present invention, preferably a lower dead point may preferably be present on the swinging trajectory against the swinging center shaft of the swinging body.

With the present invention as described above, as the lower dead point is provided on the swinging trajectory against the swinging center shaft, the swinging body and the support member are positioned at upper positions, so that the visibility of the pressing line is substantially improved. Further there is no work transfer device on the floor, so that maintenance of the pressing line is quite easy.

In the present invention, preferably one unit of the swinging body may preferably be provided between the adjoining pressing machines.

With the present invention as described above, there is only one beam spanned over the pressing machines, so that the structure is simplified with further cost reduction realized.

On the other hand, the following configuration is employed so that the present invention can effectively be applied to a case where a distance between the pressing machines is large like, for instance, in the existing device.

The work transfer device according to another aspect of the present invention includes a beam provided between the pressing machines along the work transfer direction, a feed carrier mounted on this beam and moved by the moving mechanism along the beam, a lift carrier mounted on this feed carrier and moved up and down by a lifting mechanism, and a swinging body mounted on this lift carrier and swung by a swinging mechanism along the work transfer direction.

Alternatively, the present invention may provides a work transfer device having a cross bar for supporting a work via a work holder for dismountably holding the work for transferring the work between adjoining pressing machines, and the work transfer device may include a beam provided between the pressing machines along the work transfer direction, a feed carrier mounted on this beam and moved by a moving mechanism along the beam, a lift carrier mounted on this feed carrier and driven up and down by a lifting mechanism, and a swinging body mounted on this lift carrier and driven for swinging along the work transfer direction by a swinging mechanism, in which the cross bar may be provided on the swinging body.

In the invention as described above, motions of the cross bar are set so that a work is carried out from a press machining position in the previous step and then carried into a press machining position in the next step by controlling movement of the feed carrier moved by the moving mechanism in the work transfer direction, up/down movement of the lift carrier driven by the lifting mechanism, and swinging movement of the swinging body by the swinging mechanism. With the present invention, as weights of movable bodies driven by the moving mechanism, lifting mechanism, and swinging mechanism (inertial loads) respectively are set to be smaller, the device configuration is downsized and simplified with the cost reduced, and further the production efficiency can be improved because the work transfer speed is raised. Further as a wide movable area for the cross bar can be secured by synthesizing movement of the feed carrier along the work transfer direction, up/down movement of the lift carrier, and swinging movement of the swinging body, so that a work can be carried into and out without extending the beam up to an area for the die to be carried into or carried out from. Because of this configuration, it is not necessary to once move the beam upward to outside of the carrying-in/carrying-out area for the die when exchanging the die with another one, so that the time required for exchanging the die can be shortened, which also allows improvement in production efficiency.

Further motions of the cross bar can freely be set by controlling driving operations of the moving mechanism, lifting mechanism, and swinging mechanism respectively. Especially motions of the cross bar can be set so that the cross bar can be moved towards and close to a press machining position by inletting only the swinging mechanism to prevent occurrence of interference with the die or the like without inletting the moving mechanism, lifting mechanism, and swinging mechanism into a space between the slide and bolster when a work is carried to and out from the press machining position. Because of this feature, it is not required to excessively widen a clearance between uprights (front opening dimension) for providing a space for inletting the moving mechanism, lifting mechanism, and swinging mechanism into a space between right and left ends of the slide and an inner side face of an upright, so that the present invention can provide a work transfer device capable of being advantageously used for reformation (retrofitting) of a pressing machine already having been installed in which a clearance between uprights can not be changed. On the other hand, when the work transfer device is applied to a pressing machine newly installed, as a main body of the pressing machine can be designed compact, there is provided the advantage that the initial cost can be reduced.

In the present invention, there may preferably be provided a tilt mechanism for rotating and driving the cross bar for rotation around the longitudinal axis.

In the present invention as described above, for providing the tilt mechanism, a work is inclined in the vertical direction by the tilt mechanism so that an inclination of the work inevitably generated in association with the swinging movement of the swinging body is compensated. Because of this feature, the work can be maintained in the horizontal posture, so that operations for carrying a work into and out from a press machining position can be carried out more smoothly and more accurately.

In the present invention, preferably one beam may preferably be provided spanning between the adjoining pressing machines.

With the invention as described above, as only one beam is provided spanning between the pressing machines, the structure is more simplified, which enables further cost reduction.

DETAILED DESCRIPTION OF PREFERRED EMBODIMENT(S)

First Embodiment

A first embodiment of the present invention is shown with reference to FIG. 1 to FIG. 4.

Figure 1:
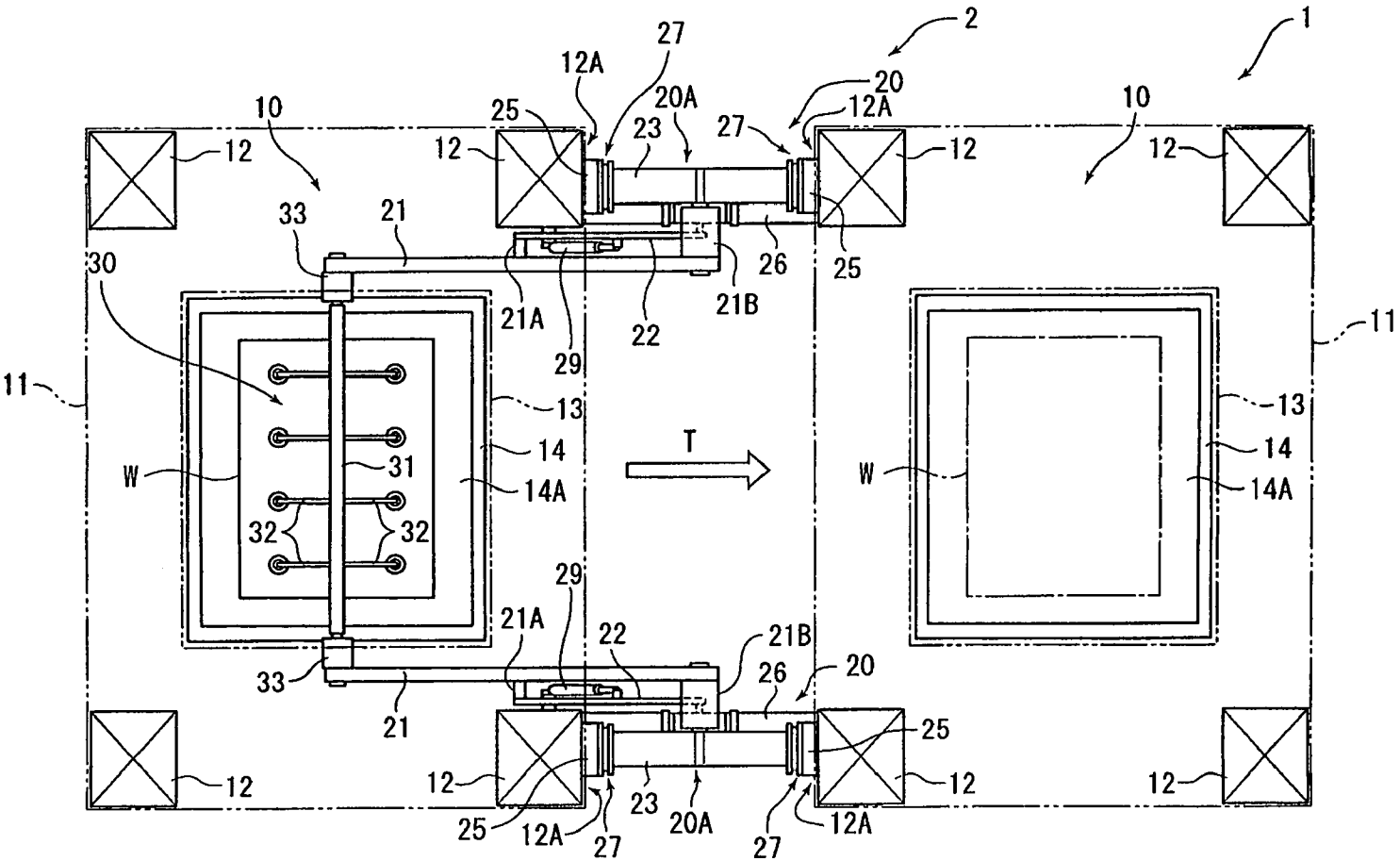
FIG. 1 is a top view showing a tandem press with a work transfer device according to a first embodiment of the present invention provided therein and with the crown omitted.
Figure 2:
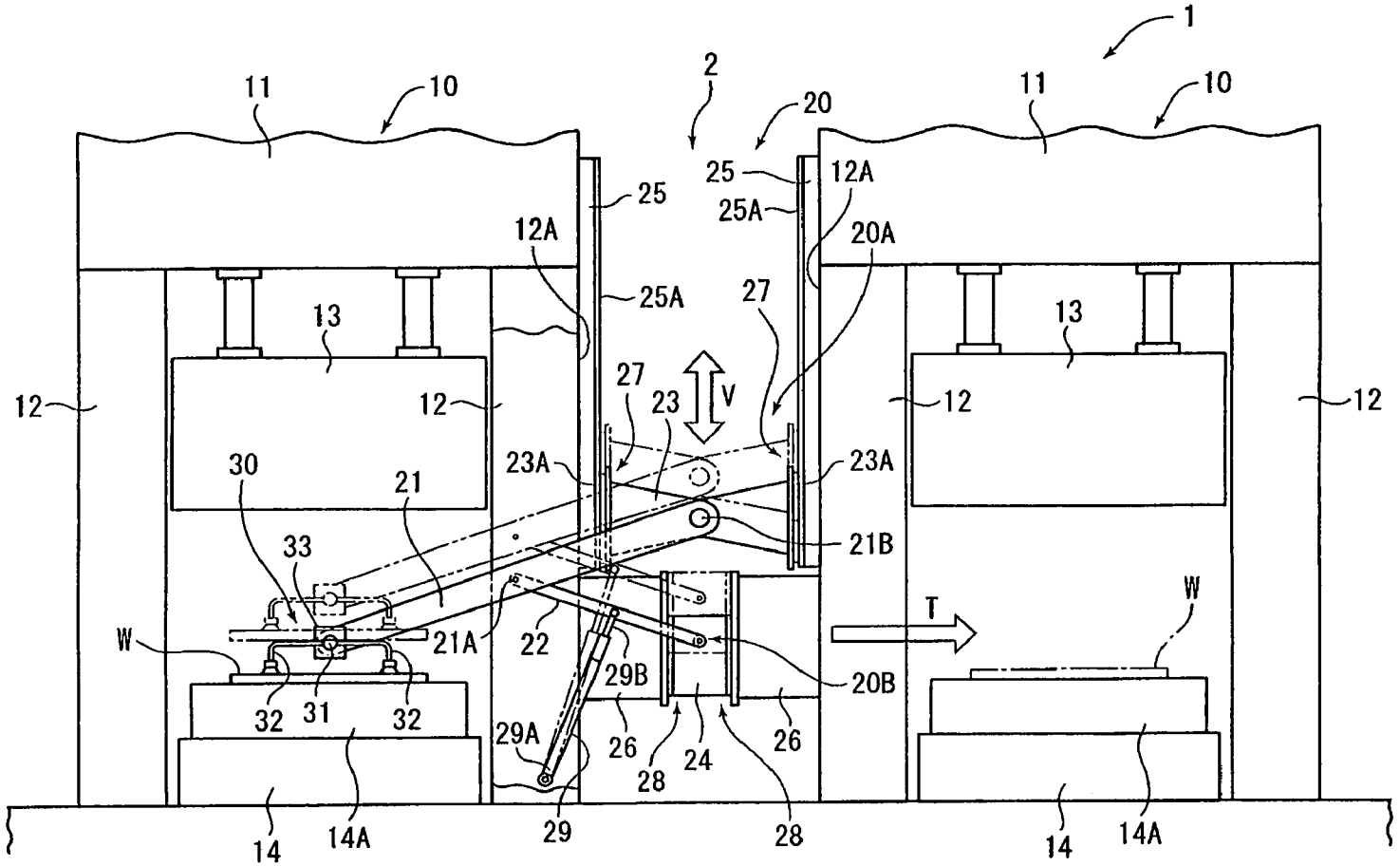
FIG. 2 is a front view showing the tandem press with a portion of the uprights omitted.

FIG. 1 is a top view showing a tandem press 1 with a work transfer device 2 according to a first embodiment of the present invention provided therein and with the crown omitted, and FIG. 2 is a front view showing the tandem press 1 with a portion of the uprights omitted.

FIG. 3A, FIG. 3B and FIG. 4A, FIG. 4B are front views each showing an operation of the work transfer device 2 respectively.

In the second and subsequent embodiments of the present invention described hereinafter, the same reference numerals are assigned to the same components or components having the same functions as those in the first embodiment described below, and the descriptions thereof are simplified or omitted herefrom.

In FIG. 1 and FIG. 2, the tandem press 1 includes a plurality of pressing machines 10 (only two units shown in FIGS. 1 and 2) sequentially and serially provided so that a work W, which is material, to be machined is sequentially machined from the upstream side to the downstream side.

The pressing machine 10 includes a crown 11 with a driving force delivery mechanism such as a crank mechanism incorporated therein, a bed not shown, and uprights 12 provided in the upright state at four corners when viewed from the top, and the crown 11, bed, and uprights 12 are connected to each other with a tie rod (not shown) penetrating each of the uprights 12 in the vertical direction. Connected to the driving force delivery mechanism in the crown 11 is a slide 13 with an upper die (not shown) attached thereto, and further a moving bolster 14 to which a lower die 14A is attached is provided on the bed.

In the pressing machine 10, the slide 13 is driven by a slide driving unit not shown in the vertical direction. This slide driving unit includes a main motor as a driving power source, a flywheel rotated by the main motor, a clutch for intermittently delivering energy generated by rotation of the flywheel to a driving force delivery mechanism in the crown 11, and a brake for stopping movement of the slide 13.

The work transfer device 2 transfers a work W machined by the pressing machine 10 in the upstream side (shown in the left side of the figures) in the work transfer direction T to the pressing machine 10 in the downstream side (shown in the right side of the figures), and is attached to a section between the uprights 12 in each pressing machine 10.

The work transfer device 2 includes a work holder 30 for holding a work W, a feed mechanism 20 for feeding the work W in the work transfer direction T (feed direction), and a lift driving unit for moving the work W up and down (including a linear motor 28 described below).

Two units of the feed mechanism 20 are provided at positions opposite to each other in the direction orthogonal to the feed direction to form a pair, and each of the feed mechanisms 20 is supported by a device supporting section 12A which is a face of the upright 12 opposite to the pressing machine 10. A pair of guide members 25 is fixed to this device supporting section 12A.

A linearly moving member (carrier) 23 is provided between a pair of guide members 25 so that the linearly moving member 23 can freely move in the vertical direction with its movement in other directions restricted.

A linear motor 27 as a diving unit for moving the linearly moving member 23 in the vertical direction is provided between the guide member 25 and the linearly moving member 23. This linear motor 27 is provided between the opposing faces of the linearly moving member 23 and the guide member 25, and includes a primary coil 23A on a side face of the linearly moving member 23 and a secondary conductor 25A (or a secondary permanent magnet) as a secondary magnet on a side face of the guide member 25.

Although not shown, the linearly moving member 23 and the guide member 25 are engaged with each other with, for instance, the LM (Linear Motion; trade name) so that the linearly moving member 23 can be driven smoothly with high precision.

A shaft section 21B which is the other end of a first ink 21 is pivotably supported on the linearly moving member 23. The first link 21 has the dimensional configuration in which a center (other end) of the shaft section 21B is positioned at an intermediate position between adjoining pressing machines 10 in relation to the feed direction, and one end thereof diagonally extends downward and reaches a substantially central position of the moving bolster 14 in the feed direction. The work holder 30 described in detail hereinafter is attached to the one end side of the first link 21 so that the work holder 30 can freely rotate around the center line orthogonal to the extending direction of the first link 21.

An end of a second link 22 is rotatably coupled via a coupling shaft 21A to an intermediate point between a center of the shaft section 21 B which is the other end of the first link 21 and a position for attaching the work holder 30 which is an end of the first link 21 (at an intermediate position between the two end shafts).

A distance between two end shafts of the second link 22 is equivalent to a half of that between two end shafts of the first link 21, and a shaft at the other end extends in the vertical direction from the center of the shaft section 21B of the first link 21.

A pair of brackets 26 is fixed to a device supporting section 12A between uprights 12 opposite to each other under the guide member 25. A support member 24 is supported between the pair of brackets 26 so that the support member 24 can freely move in the vertical direction. The other end of the second link 22 is pivotably supported on this support member 24. A position of the support member 24 in the vertical direction is fixed by a position fixing unit not shown when the work W is being fed.

A guide section 20A for linearly guiding the other end of the first link 21 in the vertical direction orthogonal to the feed direction is formed with the guide member 25 and the linearly moving member 23 described above, and a supporting point 20B for rotatably supporting the other end of the second link 22 is formed with the support member 24. Further the other end of the second link 22 is positioned on an extension line of the straight line on which the other end of the first link 21 moves being guided by the guide section 20A in the vertical direction.

The feed mechanism 20 having the configuration as described above forms the so-called Scott-Russel mechanism. Namely the feed mechanism 20 linearly drives the linearly moving member 23 in the vertical direction with the linear motor 27 in the state where movement of the supporting point 20B in the vertical direction is restricted so that the other end of the second link 22 does not move in the vertical direction, and then the first link 21 swings and the second link 22 rotates around the supporting point 20B, and the one end of the first link 21 linearly moves in the direction orthogonal to the moving direction of the linearly moving member 23. Therefore, when the linearly moving member 23 is driven by the linear motor 27, the work holder 30 attached to the one end of the first link 21 feeds the work W by moving in the work transfer direction.

The lift driving unit for moving the work W up and down is provided between the support member 24 and the bracket 26 as shown in FIG. 2, and includes a linear motor 28 for driving the support member 24 in the vertical direction. The linear motor 28 includes a primary coil provided (not shown) on a side face of the support member 24 and a secondary conductor (not shown) provided on a side face of the bracket 26. When the support member 24 is driven in the vertical direction by the linear motor 28, an lifting operation is carried out via the second link 22 so that the first link 21 and linearly moving member 23 as well as the work holder 30 attached to the first link 21 and the work W held by the work holder 30 are moved in the vertical direction.

The lift driving unit includes a holding mechanism not shown for fixing the support member 24 at a specified position of the bracket 26 to restrict movement thereof in the vertical direction when the work W is fed.

The work transfer device 2 includes an actuator 29 as an biasing unit for biasing, when the feed mechanism 20 is driven, the first link 21 so that, when one end of the first link 21 comes to a dead point (Refer to FIG. 3B) on a straight line connecting the other end of the first link 21 to the other end of the second link 22, the one end of the first link 21 moves off from the dead point and moves toward a specified position. Namely, as shown in FIG. 3B, the first link 21 rotates to the vertical posture, and in the state the one end thereof is overlaid on the other end of the second link 22, and the overlaid position is the dead point, and at this dead point the one end of the first link 21 can move both leftward and rightward, so that the actuator 29 is provided to control a moving direction of the one end of the first link 21.

The actuator 29 is of the cylinder type including a cylinder 29A and a piston 29B, and an end of the cylinder 29A is pivotably supported by the upright 12, while a tip of the piston 29B is pivotably supported at a prespecified position between the two end shafts of the second link 22. By controlling a fluid pressure (generally a hydraulic pressure) or a gas pressure (generally an air pressure) to move the piston 29B of the actuator 29 forward and backward to push or pull an intermediate position of the second link 22, the moving direction of the first link 21, to which the second link 22 is coupled, is controlled.

As shown in FIG. 1, the work holder 30 includes a cross bar 31 spanned between one ends of a pair of first links 21, a vacuum cup device 32 attached to the cross bar 31, and a tilt mechanism 33 for tilting the work W.

The cross bar 31 is a hollow rod-like member, and two ends thereof are supported via the tilt mechanism 33 by one ends of a pair of first links 21. The vacuum cup device 32 capable of sucking the work W at a plurality of positions (8 positions in this embodiment) is attached to the cross bar 31.

The cross bar 31 and vacuum cup device 32 are the same ones as those used in the ordinary transfer feeder and the like, and have an appropriate rigidity and a force enough to hold (suck) the work.

The device for holding a work is not limited to the vacuum cup device 32, and for instance, a finger device having a pair of fingers for holding side rim portions of the work W or a gripper device having a pair of grippers for gripping side rime portions of the work W may be employed for the same purpose.

The tilt mechanism 33 is a mechanism for rotating the cross bar 31 around the shaft in response to rotation of the first link 21 when the feed mechanism 20 is driven to feed the work W, and includes a motor (not shown) for detecting a rotational angle of the first link 21 and driving the first link 21 or a gear (not shown) for delivering rotation of the motor to the cross bar 31.

In this embodiment, a mechanism for moving the work W up and down is not provided in the work holder 30, but also the configuration is allowable in which the work holder 30 includes a lift driving unit for movably supporting the cross bar 31 or the vacuum cup device 32 in the vertical direction and moving the held work W up and down.

Next operations of the work transfer device 2 for transferring a work are described below.

At first, in succession to machining of the work W by the pressing machine 10 and upward movement of the slide 13, as shown in FIG. 2, the feed mechanism 20 is driven to move (return) one end side of the first link 21 to a position between the slide 13 and the moving bolster 14 of the pressing machine 10 in the upstream side in the work transfer direction, namely to a position above the work W.

Then the support member 24 is moved downward by the linear motor 28 which is a lift driving unit to move downward the first link 21 and the work holder 30 to suck and hold the work W on the lower die 14A with the vacuum cup device 32. Then the support member 24 is driven upward by the linear motor 28 to move (lift) the first link 21 and the work holder 30 upward for the purpose to pull up the work W off from the lower die 14A (as indicated by the chain double-dashed line in FIG. 2).

Figure 3A:
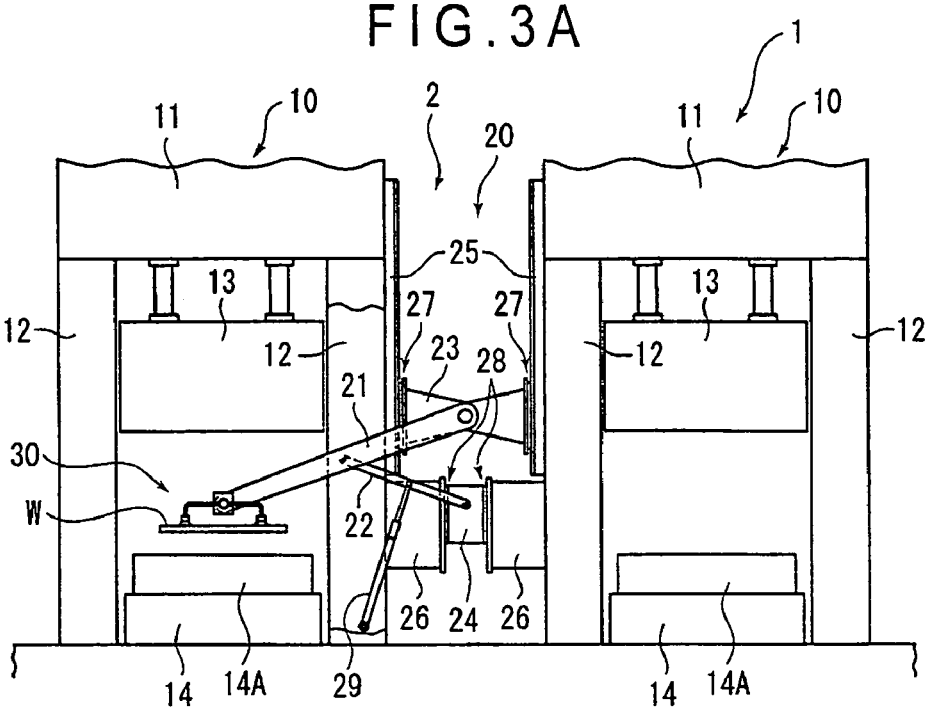
FIG. 3A and FIG. 3B are front views each showing an operation of the work transfer device.
Figure 3B:
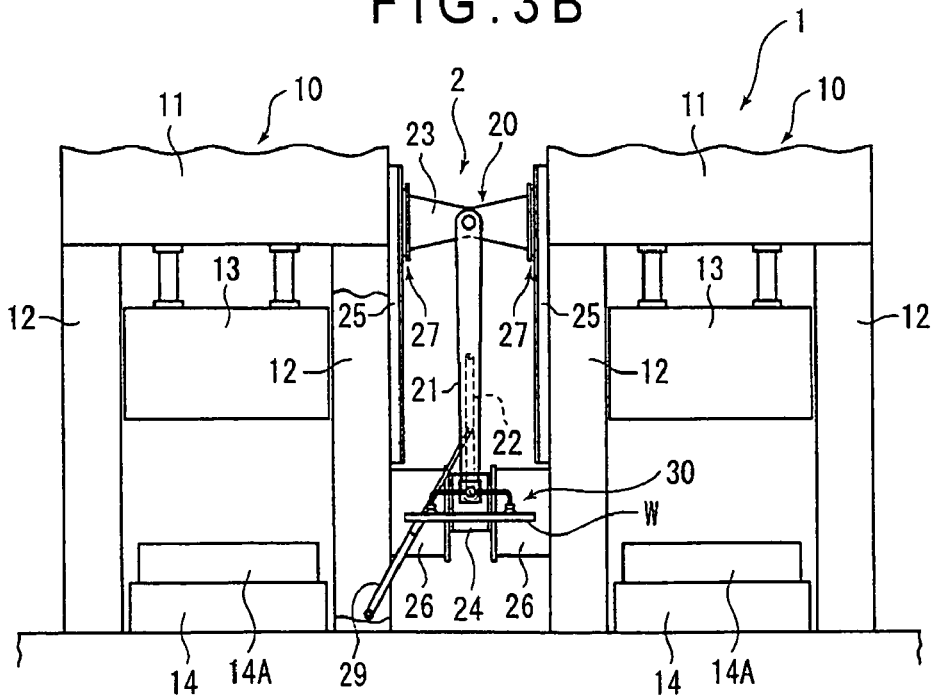

Then by driving the linearly moving member 23 upward with the a linear motor 27 as a driving unit for the feed mechanism 20 as shown in FIG. 3A and FIG. 3B, the first link 21 and the second link 22 swing, and the one end side of the first link 21, work holder 30, and work W move (are fed) along the feed direction. When the first link 21 is set in the vertical posture and the end thereof comes to the dead point (See FIG. 3B), the linearly moving member 23 is driven downward by the linear motor 27, and an intermediate position of the second link 22 is pushed by the piston 29B of the actuator 29, the end of the first link 21 moves (is fed) toward the pressing machine 10 in the downstream side in the feed direction. In this step, by rotating the cross bar 31 around the shaft with the tilt mechanism 33 according to a rotational angle of the first Link 21, posture of the work W is not inclined against the horizontal axis.

Figure 4A:
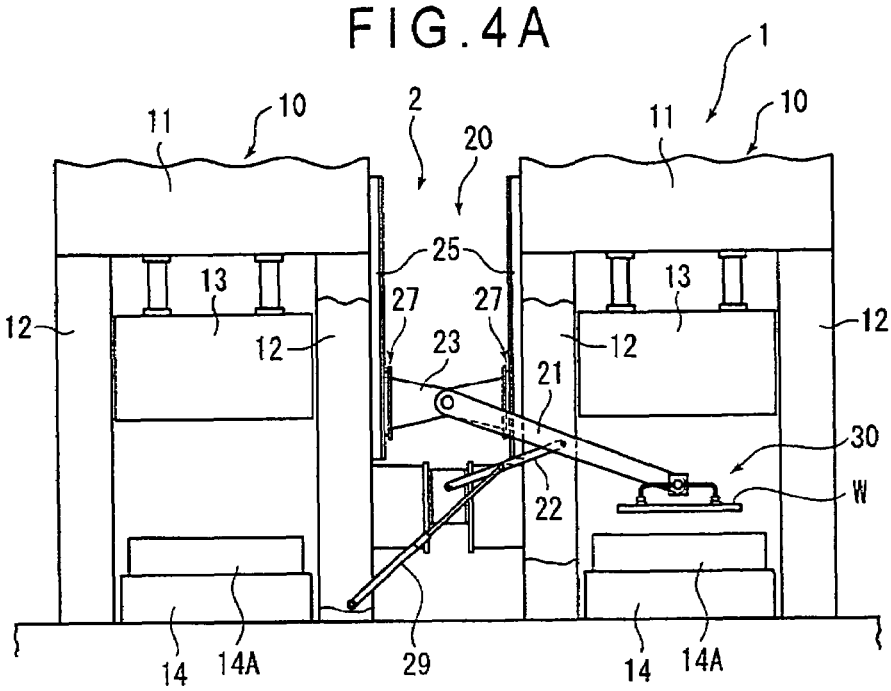
FIG. 4A and FIG. 4B are front views each showing an operation of the work transfer device.
Figure 4B:
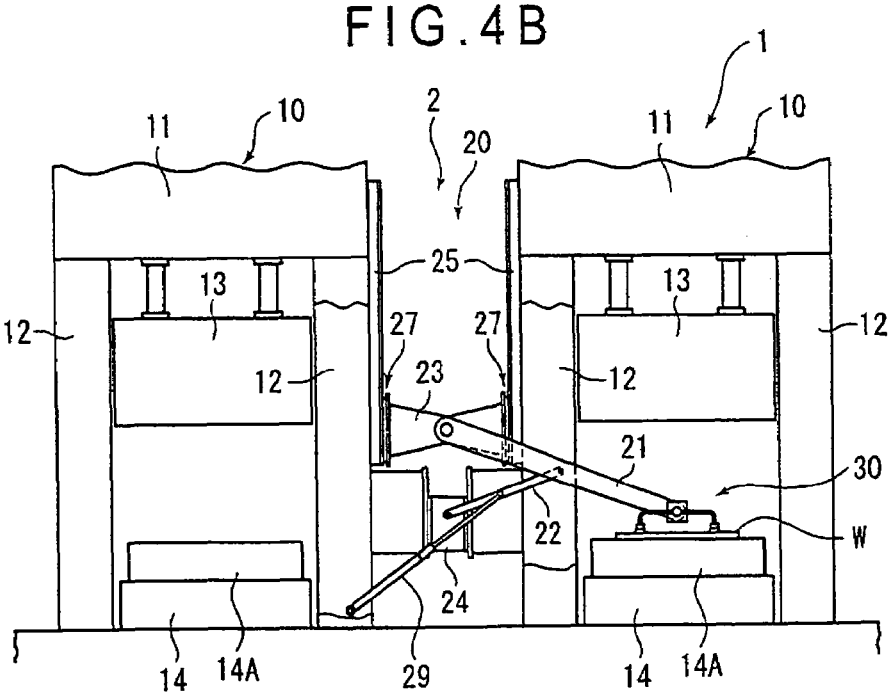

After the one end of the first link 21 is moved to the pressing machine 10 in the downstream side in the feed direction as shown in FIG. 4A and FIG. 4B (See FIG. 4A), the support member 24 is driven downward by the linear motor 28 to move downward the first link 21 and the work holder 30 for the purpose to place the work W on the lower die 14A of the pressing machine 10 in the downstream side, and then the holding mode of the vacuum cup device 32 is released (See FIG. 4B).

Then the support member 24 is moved upward by the linear motor 28 to move (lift) the first link 21 and the work holder 30 upward, and further the linearly moving member 23 is driven by the linear motor 27 for the feed mechanism 20 to move (return) the one end of the first link 21 toward the pressing machine 10 in the upstream side in the opposite side against the feed direction. In this step, by pulling the intermediate position of the second link 22 with the piston 29B of the actuator 29 when the end section passes through the dead point in the contrary direction, the one end of the first link 21 is moved (returned) toward the pressing machine 10 in the upstream side in the feed direction.

By repeating the operations described above, the work W can be fed sequentially from the pressing machine 10 in the upstream side to the pressing machine 10 in the downstream side.

With the first embodiment as described above, there are provided the following advantages.

(1) As the feed mechanism 20 is supported between the uprights 12 of adjoining pressing machines 10, it is not necessary to secure a trajectory for swiveling like in the robot arm type transfer device, nor to provide a lift beam at an inner position from the upright like in the feeder type transfer device, and therefore size of the tandem press 1 as a whole can be reduced.

(2) As the work transfer device 2 includes the feed mechanism 20 for rotating the first link 21 and the second link 22 when driven by the driving unit and also moving the one end of the first link 21 in the feed direction, the work W held by the work holder 30 is transferred along the feed direction. Therefore as the work W can be transferred by the feed mechanism 20 supported between the uprights 12 of the pressing machines 10, it is not necessary to provide the linear motor 27 as a driving unit, for instance, at a position close to the slide 13 within the work transfer area, so that the linear motor 27 can easily be checked and serviced from the outside of the pressing machine 10.

(3) Further as no heavy matter such as a driving power source is provided in the one end side of the first link 21 moving in the feed direction, and therefore as compared to a case in which a driving power source such as a linear motor is provided in a carrier driven in the feed direction like in the feeder type transfer device, weight of the movable body is substantially reduced and load for driving can be reduced, so that energy saving can be promoted.

Further even when interference between the work transfer device 2 and the die should occur, the damage does not affect the driving power source, so that a long period of time is not required for system restoration.

(4) Further as the feed mechanism 20 forms the so-called Scott-Russel mechanism and the shaft section 21B of the first link 21 is linearly driven by the linear motor 27, the one end of the first link 21 linearly moves in a direction orthogonal to the moving direction of the shaft section 21B, namely in a direction parallel to the work transfer direction. Therefore, as also the work holder 30 attached to the one end side of the first link 21 linearly moves likewise, the area for a trajectory of the work W can be minimized, so that further size reduction of the pressing machine 10 is possible. Further as the work W linearly moves, the work transfer distance becomes the shortest, so that the transfer efficiency can be improved.

(5) As the other end of the first link 21 guided by the guide member 25 and the linearly moving member 23 is linearly driven by the linear motor 27, the work W can be transferred at a higher speed and with a higher precision as compared to a driving mechanism in which a motor for rotation and a gear and the like are combined.

(6) Further as the lift driving unit includes the linear motor 28, when the work W is transferred, the work W is pulled up and raised (lifted) from the lower die 14A of the pressing machine 10 in the upstream side and can be set in the lower die 14A of the pressing machine 10 in another side from above, so that the work W can be transferred smoothly with a higher precision. Especially, when the work W is a solid one with a large bending height (formed, for instance, by deep-drawing machining), the work W can be lifted and pulled off from the lower die 14A, which is advantageous.

(7) When an end of the first link 21 comes to the dead point, the one end of the first link 21 can be biased for passing through the dead point in a suited direction by pushing the intermediate position of the second link 22 with the actuator 29, so that swinging of the first link 21 can be controlled more accurately and the work W can be transferred with a higher precision.

(8) Further as posture of the work W is controlled by the tilt mechanism 33 so that the posture will not be inclined against the horizontal axis during feeding, so that the operations for carrying the work W into or out from a press machining position can be carried out more smoothly and accurately.

In addition, it is possible to intentionally tilt and place the work W during transfer on the lower die 14A in the next step, so that a freedom in designing the die can be improved.

Second Embodiment

The work transfer device 2 according to a second embodiment of the present invention is described with reference to FIG. 5.

The work transfer device 2 according to the second embodiment is different from the first embodiment in configuration and operations of the driving unit for the feed mechanism 20 and the lift driving unit according to the first embodiment. Namely in the first embodiment, a driving unit for the feed mechanism 20 is the linear motor 27, and when the linearly moving member 23 is moved up and down (in the lifting direction V) by the linear motor 27, an end side of the first link 21 moves (is fed) along the work transfer direction. In contrast, in the second embodiment, the supporting point 20B for the second link 22 is rotated and driven to rotate the second link 22, so that the first link 21 swings and an end side thereof moves along the work transfer direction.

In the first embodiment, the lift driving unit includes the linear motor 28, but in the second embodiment, the lift driving unit includes a lift driving unit having a rotating/driving motor.

The differences of the second embodiment from the first embodiment are described in detail below.

Figure 5:
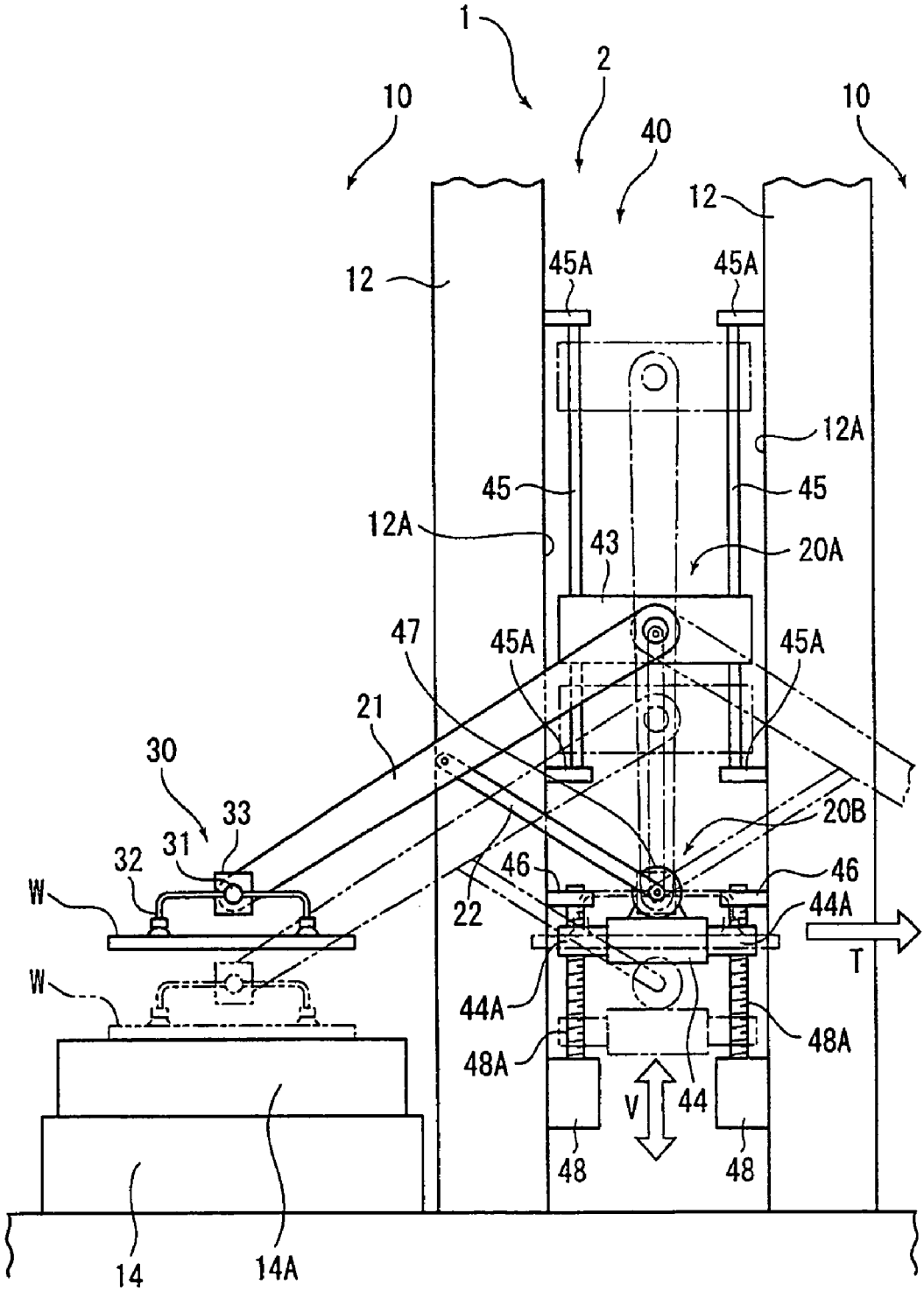
FIG. 5 is a front view showing a key section of a tandem press with a work transfer device according to a second embodiment of the present invention provided therein.

FIG. 5 is a front view showing a key section of the tandem press 1 in which the work transfer device 2 according to this embodiment is provided.

In FIG. 5, the work transfer device 2 includes a feed mechanism 40 supported by the device supporting section 12A which are opposite faces of the uprights 12 opposing to each other of adjoining pressing machines 10. A pair of lengthy rod-like guide members 45 fixed to each other via a bracket 45A is fixed to the device supporting section 12A.

A linearly moving member (carrier) 43 with the movement in directions other than in the vertical direction restricted is supported on the pair of guide members 45 so that the linearly moving member 43 can freely move in the vertical direction. Namely a guide section 20A for guiding the other end of the first link 21 in the vertical direction crossing the feed direction is formed with a guide hole (not shown) provided in the linearly moving member 43 and a guide member 45 penetrating through this guide hole.

Further a pair of lift driving devices 48 is fixed to the device supporting section 12A for the opposing uprights 12 in the lower section of the guide member 45. The lift driving device 48 has a motor not shown and a screw shaft 48A rotating when rotation of the motor is delivered thereto, and an upper end of this screw shaft 48A is pivotably supported by a bracket 46 fixed to the device supporting section 12A for the uprights 12. A support member 44 is supported by the lift driving device 48 by setting two end sections 44A of the support member 44 to the screw shaft 48A with screws.

Further fixed to the upper section of the support member 44 is a driving motor 47 as a rotation driving unit, and the other end of the second link 22 is coupled to a rotating shaft of this driving motor 47. Namely, the supporting point 20B is formed with the rotating shaft of the driving motor 47, and the second link 22 is rotatably supported on and around this supporting point 20B.

The feed mechanism 40 having the configuration as described above rotates the second link 22 with the driving motor 47, and then the first link 21 with one end of the second link 22 coupled thereto swings, and the linearly moving member 43 with the other end of the first link 21 pitovably supported thereon moves in the vertical direction, and also the one end of the first link 21 moves in the feed direction. Therefore, when the driving motor 47 rotates and drives the second link 22, the work holder 30 attached to one end of the first link 21 moves in the work transfer direction to carry out the feed operation.

The lift driving unit in the second embodiment includes the lift driving device 48, and forms the so-called feed screw shaft mechanism for moving the support member 44 with the two end sections 44A thereof screwed into the screw shaft 48A moves in the vertical direction when the screw shaft 48A of the lift driving device 48 is rotated with a motor. Therefore, the lift operation for moving up and down the support member 44, first link 21, second link 22, and work holder 30 is executed when driven and rotated by the screw shaft 48A of the lift driving device 48.

Next operations of the work transfer device 2 for transferring a work are described below.

Operations of the work transfer device 2 are the substantially same as those in the first embodiment described above, and in the pressing machine 10 in the upstream side in the work transfer direction, the first link 21 and the work holder 30 are moved downward by driving the lift driving device 48 to hold a work W, and then the work W is pulled up from the lower die 14A (lifting).

Then the second link 22 is driven and rotated by the driving motor 47 of the feed mechanism 40 to feed the work W toward the pressing machine 10 in the downstream side. Also when one end of the first link 21 comes to the dead point, the driving motor 47 rotates in a prespecified direction to drive the first link 21 in a prespecified direction, so that the biasing unit is not provided in this embodiment.

Next in the pressing machine 10 in the downstream side, the lift driving device 48 is driven to move the work W downward and place the work W on the lower die 14A, and after retention by the vacuum cup device 32 is released, the first link 21 and the work holder 30 are moved upward (lifting). Then the second link 22 is driven and rotated by the driving motor 47 to move (return) the one end of the first link 21 and the work holder 30 toward the pressing machine 10 in the upstream side.

By repeating the operations described above, the work W is sequentially transferred from the pressing machine 10 in the upstream side to the pressing machine 10 in the downstream side.

With the second embodiment as described above, in addition to the advantages (1) to (4) and (8) described above, the following advantage is provided:

(9) Namely, as the driving unit for the feed mechanism 40 is formed with the driving motor 47 fixed to the support member 44, it is not necessary to provide a driving power source at the one end of the second link 22 nor in any movable portions such as the first link 21 and linearly moving member 43, and therefore weight of the movable portions can further be reduced with load for driving reduced, which promotes energy saving.

Third Embodiment

Next the work transfer device 2 according to a third embodiment of the present invention is described below with reference to FIG. 6.

The work transfer device 2 according to the third embodiment is different from the first embodiment in configurations and operations of the driving unit for the feed mechanism 20 and the lift driving unit. Namely, in the first embodiment, the driving unit for the feed mechanism 20 is formed with the linear motor 27, but in the third embodiment, the driving unit includes the so-called feed screw shaft mechanism having a motor for rotation and driving and a screw shaft.

Further in the first embodiment, the lift driving unit is formed with the linear motor 28 for driving the support member 24 up and down, but in the third embodiment, the lift driving unit includes a rotating/driving motor for driving a sliding frame supporting the entire feed mechanism as well as a rack.

The differences from the first embodiment are described in detail below.

Figure 6:
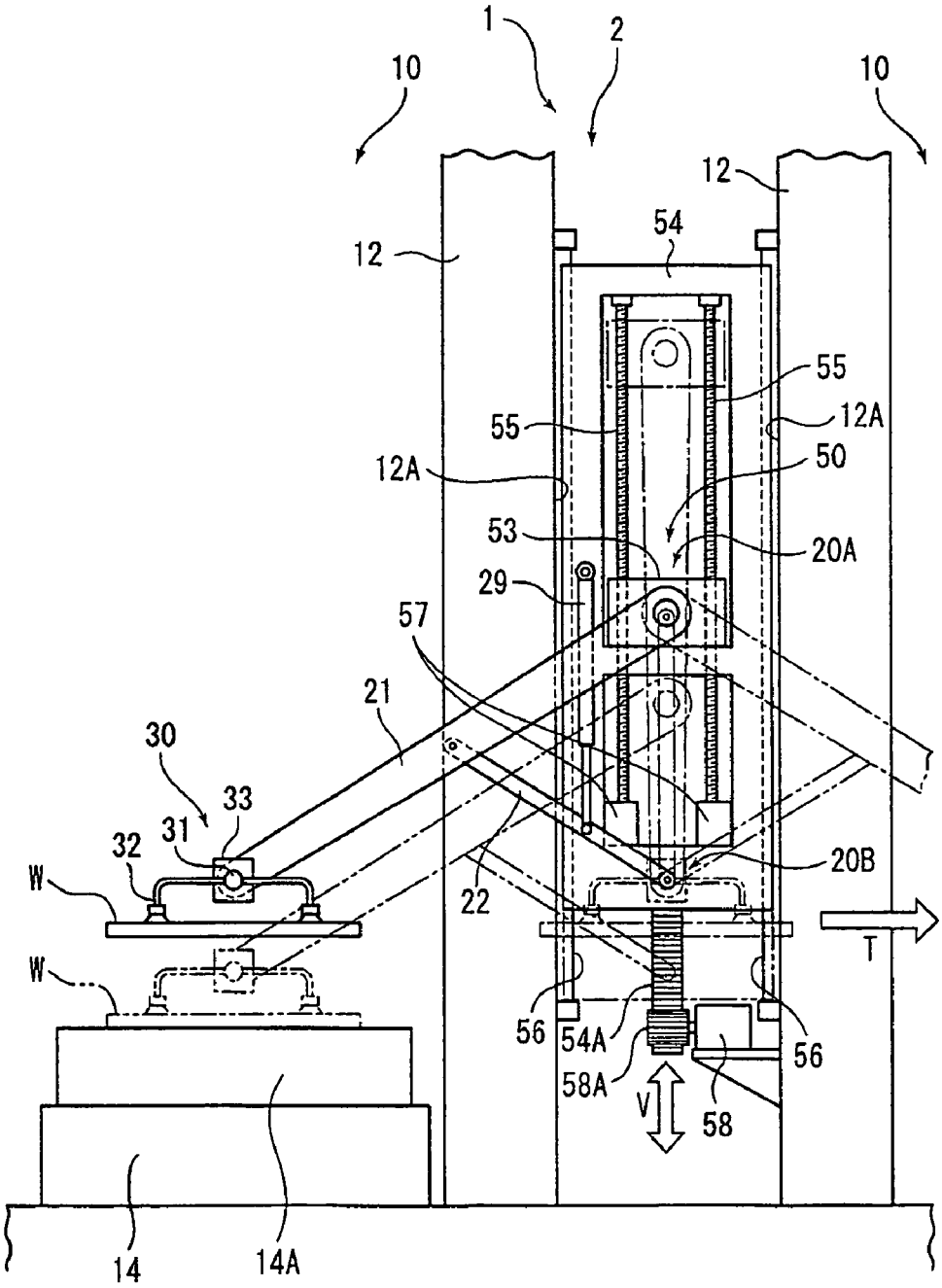
FIG. 6 is a front view showing a key section of a tandem press with a work transfer device according to a third embodiment of the present invention provided therein.

FIG. 6 is a front view showing a key section of the tandem press 1 in which the work transfer device 2 according to the third embodiment is provided.

In FIG. 6, the work transfer device 2 includes a feed mechanism 50 supported by the device supporting section 12A which are opposing faces of the uprights 12 opposing to each other of the adjoining pressing machines 10. This feed mechanism 50 is provided on a sliding frame 54 on a guide rail 56 fixed to the device supporting section 12A so that the feed mechanism 50 can move in the vertical direction along the guide rail 56.

Two screw shafts 55 are provided inside the sliding frame 54, and a linearly moving member (carrier) 53 is supported on the screw shafts 55 by setting screws in screw holes not shown. The other end side of the first link 21 is pivotably supported on this linearly moving member 53. Because of this configuration, the guide section 20A for linearly guiding the other end of the first link 21 in the vertical direction (lifting direction V) orthogonal to the feed direction is formed with the screw shafts 55 and the linearly moving member 53 capable of moving in the vertical direction along the screw shaft 55 in association with rotation of the screw shafts 55.

A driving motor 57 is coupled to lower ends of the two screw shafts 55 respectively, and when the screw shafts 55 are rotated by the driving motor 57, the linearly moving member 53 screwed to the screw shafts 55 is driven in the vertical direction. In association with vertical movement of this linearly moving member 53, the other end of the first link 21 moves up and down and also the first link 21 swings with the one end of the first link 21 moved in the feed direction. Namely the driving unit for the feed mechanism 50 includes the driving motor 57, screw shaft 55, and linearly moving member 53. Therefore, when the linearly moving member 53 is moved up and down with the driving motor 57 and screw shafts 55, the work holder 30 attached to the one end of the first link 21 moves in the work transfer direction to carry out the feed operation.

An end of the second link 22 is rotatably coupled via the coupling shaft 21A to an intermediate point between a center of the shaft section 21B which is the other end of the first link 21 and a point for attaching the work holder 30 which is the one end of the first link 21.

The distance between two ends of the second link 22 is equivalent to a half of that between two ends of the first link 21, and the other end thereof is positioned under a center of the shaft section 21B of the first link 21 in the vertical direction and also on the sliding frame 54.

Further there is provided the actuator 29 as an biasing unit for biasing the one end of the first link 21 so that the end passes off from the dead point in a prespecified side when the one end of the first link 21 comes to the dead point positioned on a straight line connecting the other end of the first link 21 to the other end of the second link 22. An end section of a cylinder 29A of the actuator 29 is pivotably supported on the sliding frame 54, while a tip of a piston 29B of the actuator 29 is pivotably supported at a prespecified position between two end shafts of the second link 22.

Further provided under the sliding frame 54 are a motor 58 fixed to a bracket of the device supporting section 12A for the upright 12 and a pinion 58A fixed to a rotating shaft of the motor 58. A rack 54A fixed to the lower side of the sliding frame 54 and extending downward is engaged with the pinion 58A, so that the sliding frame 54 is driven in the vertical direction in association with rotation of the motor 58. Namely the lift driving unit is formed with the motor 58, pinion 58A, and rack 54A, and the lifting operation for moving the entire sliding frame 54 supporting the feed mechanism 50 and the work holder 30 is carried out when the lift driving unit is driven and rotated by the motor 58.

Next operations of the work transfer device 2 for transferring a work are described below.

Operations of the work transfer device 2 are the substantially same as those in the first embodiment described above, and in the pressing machine 10 in the upstream side in the work transfer direction, the motor 58 as a lift driving unit is driven to move the sliding frame 54 and the work holder 30 downward to hold the work W, and then the work W is pulled up from the lower die 14A (lifting).

Then the screw shafts 55 are rotated with the driving motor 57 for the feed mechanism 50 to move the linearly moving member 53 in the vertical direction for the purpose to feed the work W toward the pressing machine 10 in the downstream side. In this step, one end of the first link 21 passes through the dead point when an intermediate position of the second link 22 is pressed by the actuator 29 pivotably supported on the sliding frame 54.

Then in the pressing machine 10 in the downstream side, the motor 58 is driven to move the work W downward (down) and place the work W on the lower die 14A, and then after retention by the vacuum cup device 32 is released, the sliding frame 54, first link 21, and work holder 30 are moved upward (lifting). Then the driving motor 57 is driven to move (return) an end of the first link 21 and work holder 30 toward the pressing machine 10 in the upstream side.

By repeating the operations described above, the work W is transferred sequentially from the pressing machine 10 in the upstream side to the pressing machine 10 in the downstream side.

With the third embodiment described above, in addition to the advantages (1) to (4), (7) and (8) described above, the following advantage is provided.

(10) Namely the driving unit for the feed mechanism 50 includes the driving motor 57 provided in the sliding frame 54, screw shafts 55, and linearly moving member 53 screwed to the screw shafts 55, so that it is not required to provide a motor or the like as a driving power source in the linearly moving member 53 nor in the first link 21, and therefore weight of the movable portions can further be reduced and also load for driving is reduced, which enables promotion of energy saving.

Fourth Embodiment

The work transfer device 2 according to a fourth embodiment of the present invention is described below with reference to FIG. 7.

The work transfer device 2 according to the fourth embodiment is different from the first embodiment in the direction in which the feed mechanism 40 is set. Namely in the first embodiment, the linearly moving member 23 in the feed mechanism 20 moves in the vertical direction, and the first link and second link swing on a vertical plane. In contrast, in the fourth embodiment, the linearly moving member moves in the horizontal direction crossing the work transfer direction, and the first link 21 and second link 22 swing on a horizontal plane.

The differences from the first embodiment are described in detail below.

Figure 7:
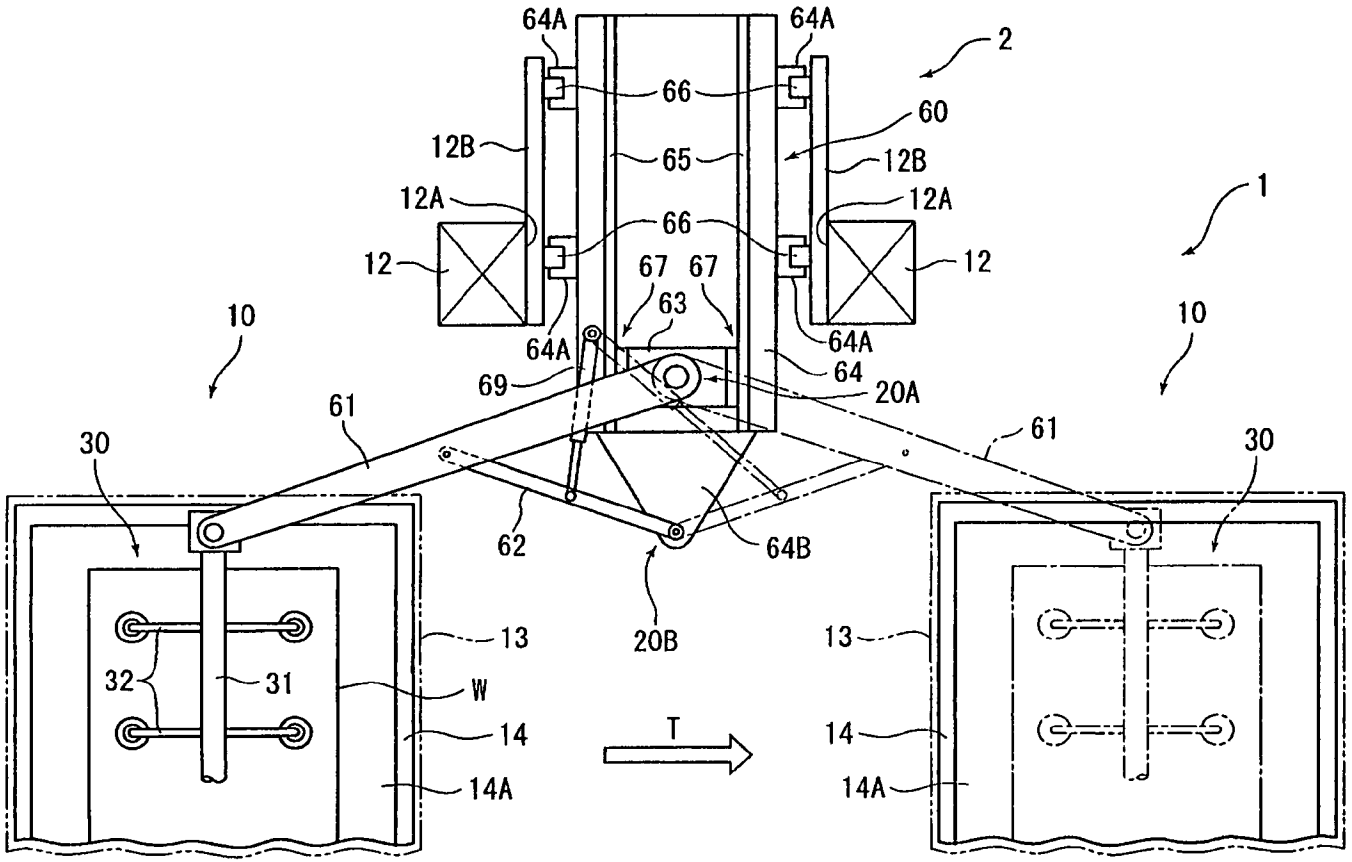
FIG. 7 is a front view showing a key section of a tandem press with a work transfer device according to a fourth embodiment of the present invention provided therein.

FIG. 7 is a flat view showing a key section of the tandem press 1 with the work transfer device 2 according to the fourth embodiment provided therein.

In FIG. 7, the work transfer device 2 includes a feed mechanism 60 supported by the device supporting section 12A which are opposing faces of opposing uprights 12 of adjoining pressing machines 10.

The feed mechanism 60 has a base member 64 supported on the bracket 12B fixed to the device supporting section 12A so that the base member 64 can freely move in the vertical direction. This base member 64 can move in the vertical direction because a guide holding section 64A provided on a side face thereof and having a concave cross section slidably holds a lift guide 66 provided on the bracket 12B and extending in the vertical direction.

The feed mechanism 60 as a whole can be moved (lifted) up and down by driving the base member 64 up and down with a lift driving unit not shown.

Further the feed mechanism 60 includes a fist link 61 with the work holder 30 attached to one end side thereof, a second link 62 with one end side thereof connected to an intermediate position between two end shafts of this first link 61, a linearly moving member (carrier) 63 pivotably supporting the other end of the first link 61, and a bracket 64B supporting the other end of the second link 62.

The configuration is the same as that in the first embodiment, but in this embodiment, the first link 21, second link 22, linearly moving member 23, and support member 24 are rotated by 90 degrees against the horizontal axis parallel to the work transfer direction. Further the bracket 64B as a supporting point is different from that in the first embodiment, and is fixed to a side section of the base member 64, and the bracket 64B moves together with the base member 64 in the vertical direction when lifted.

The linearly moving member 63 is supported by a guide rail 65 formed on the base member 64 so that the linearly moving member 63 can freely move in the horizontal direction, but movement thereof in directions other than in the horizontal direction are restricted. The linearly moving member 63 is driven in the horizontal direction by a linear motor 67 as a driving unit. This linear motor 67 is provided between opposing faces of the linearly moving member 63 and the guide rail 65, and is formed with a primary coil on a side face of the linearly moving member 63 and a secondary conductor (or a secondary permanent magnet) on a side face of the guide rail 65.

A guide section for linearly guiding the other end of the first link 61 in a direction crossing the feed direction (in the horizontal direction) is formed with the linearly moving member 63 and the guide rail 65.

There is provided the actuator 29 as a biasing unit for biasing, when the one end of the first link 61 comes to a dead point positioned on a straight line connecting the other end of the first link 61 to that of the second link 62, the one end of the first link 61 goes off from the dead point in the prespecified side. An end section of the cylinder 29A of the actuator 29 is pivotably supported by the base member 64, and a tip of the piston 29B of the actuator 29 is pivotably supported at a prespecified position between two ends of the second link 62.

The tilt mechanism 3 is a mechanism for rotating the cross bar 31 around the vertical axis at the attached position in response to rotation of the first link 61 when the work W is fed by driving the feed mechanism 60, and includes, for instance, a motor (not shown) for detecting a rotational angle of the first link 61 and driving the first link 61, and a gear (not shown) for delivering rotation of the motor to the cross bar 31.

Next operations of the work transfer device 2 for transferring a work are described.

Operations of the work transfer device 2 are the substantially same as those in the first embodiment described above, and in the pressing machine 10 in the upstream side in the work transfer direction, the feed mechanism 60 and the work holder 30 are moved downward with a lift driving unit (not shown) to hold the work W, and then the work W is pulled up from the lower die 14A (lifting).

Then by driving the linearly moving member 63 in the horizontal direction (upward in FIG. 7) with the linear motor 67, the first link 61 swings the one end side thereof to move along the work transfer direction, and the work W is fed toward the pressing machine 10 in the downstream side. Then, when the one end side of the first link 61 passes through the dead point, an intermediate position of the second link 62 is biased, and when the end of the first link 61 has passed through the dead point, the linearly moving member 63 is driven downward in FIG. 7 with the linear motor 67 to move (feed) the work W up to the pressing machine 10 in the downstream side.

Then in the pressing machine 10 in the downstream side, the lift driving unit (not shown) is driven to move downward the work W to place the work W on the lower die 14A, and after retention by the vacuum cup device 32 is released, the feed mechanism 60 is moved upward (lifted). Then the linearly moving member 63 is driven by the linear motor 67 to move (return) the first link 61 to the pressing machine 10 in the upstream side.

By repeating the operations as described above, the work W is sequentially transferred from the pressing machine 10 in the upstream side to the pressing machine 10 in the downstream side.

With the fourth embodiment described above, in addition to the advantages (1) to (5) and (7) described above, the following advantages are provided.

(11) Namely as the feed mechanism 60 is provided in the horizontal posture, the feed mechanism 40 can be set, for instance, on the pressing machine 10 with the set space in the vertical direction restricted. Further the linearly moving member 63 and the first link 61 are driven in the horizontal direction, change in positional energy is less as compared to the case where the components are driven in the vertical direction, which allows improvement in the driving efficiency.

(12) Further as the first link 61 rotates on a horizontal plane, interference with the slide 13 of the pressing machine 10 is reduced, and therefore after the work W is machined, the first link 61 and work holder 30 can be moved into the pressing machine 10 at an earlier timing while the slide 13 starts to move upward. Because of the feature, a waiting time relating to a motion of the slide 13 in the transfer step can be reduced, and as a result, the entire process in the tandem press can be carried out within a shorter period of time.

(13) Further by controlling a posture of the work W according to the necessity with the tilt mechanism 33 so that the work W will not be tilted against the vertical axis during feeding, the operations for carrying the work W into and out from the press machining position can be performed more smoothly and more accurately.

In each of the first to fourth embodiments, the work transfer device 2 includes the feed mechanisms, 20, 40, 50, and 60 set as a pair in both sides orthogonal to the work transfer direction respectively, but the configuration is not limited to that described above, and the work transfer device may include only one feed mechanism. In this case, by attaching the work holder to the feed mechanism in the cantilever state, a work can be transferred with one feed mechanism supported between uprights.

In each of the first to fourth embodiments, the feed mechanisms 20, 40, 50, and 60 form the so-called Stott-Russel mechanism respectively, but the present invention is not limited to this configuration, and lengths of the first and second links, a position for attaching the second link to the first link, and positions of other end sides of the first and second links may freely be decided and set according to the necessity. However, when the feed mechanism forms the so-called Stott-Russel mechanism, a work can be transferred linearly and also a trajectory for transferring a work can easily be set, so that the configurations described in the embodiments above are preferable.

In each of the first to fourth embodiments, the other ends of the first link 21, 61 are driven in the vertical direction or in the horizontal direction, but the present invention is not limited to this configuration, and any configuration is allowable on the condition that the other end is linearly driven in a direction orthogonal to the work transfer direction, and for instance, the configuration is allowable in which the other end of the first link is driven in a direction inclined against the horizontal direction.

Fifth Embodiment

Next the work transfer device 2 according to a fifth embodiment of the present invention is described with reference to FIG. 8 to FIG. 10.

Figure 8:
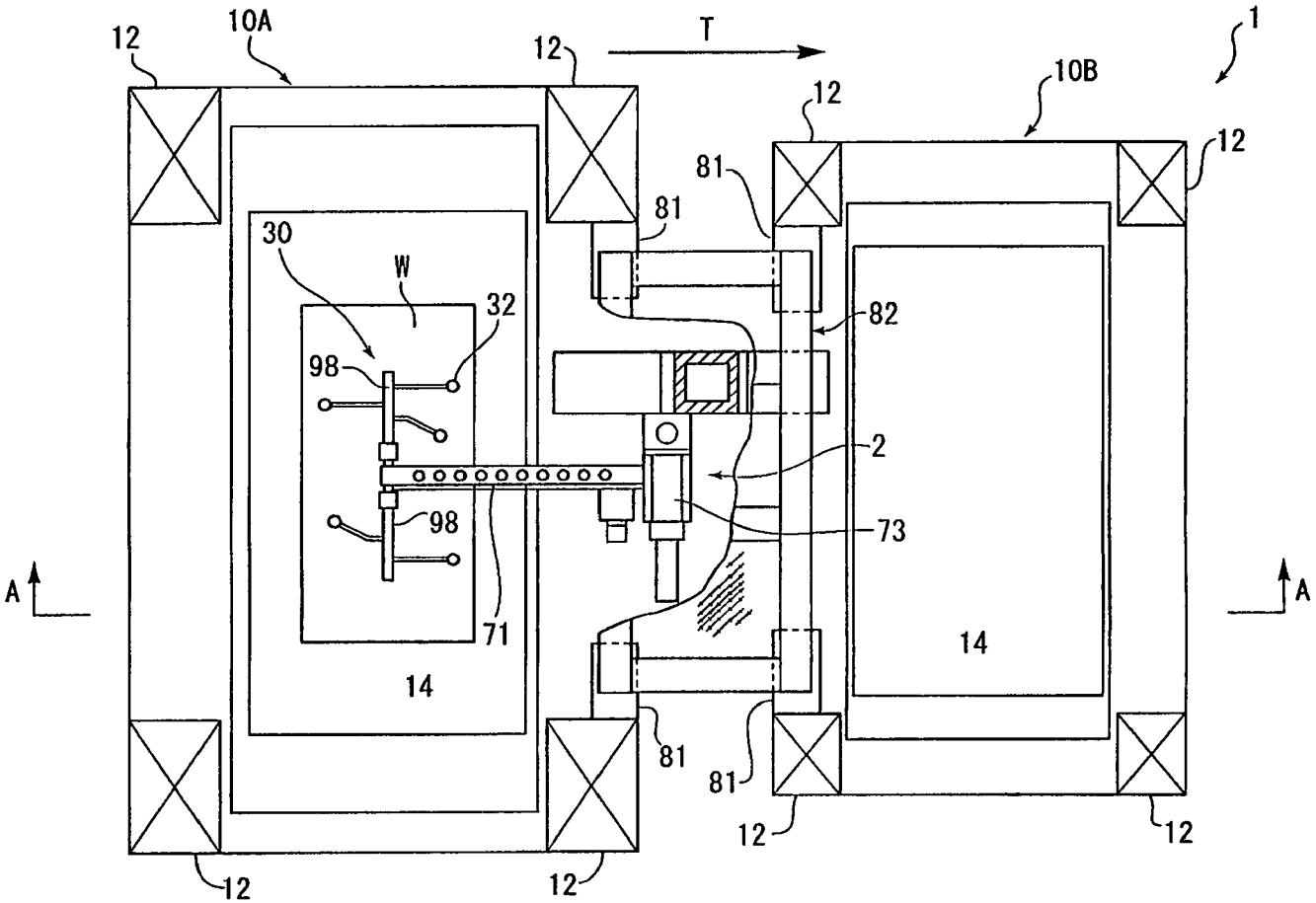
FIG. 8 is a general flat view showing a tandem press line according to a fifth embodiment of the present invention.
Figure 9:
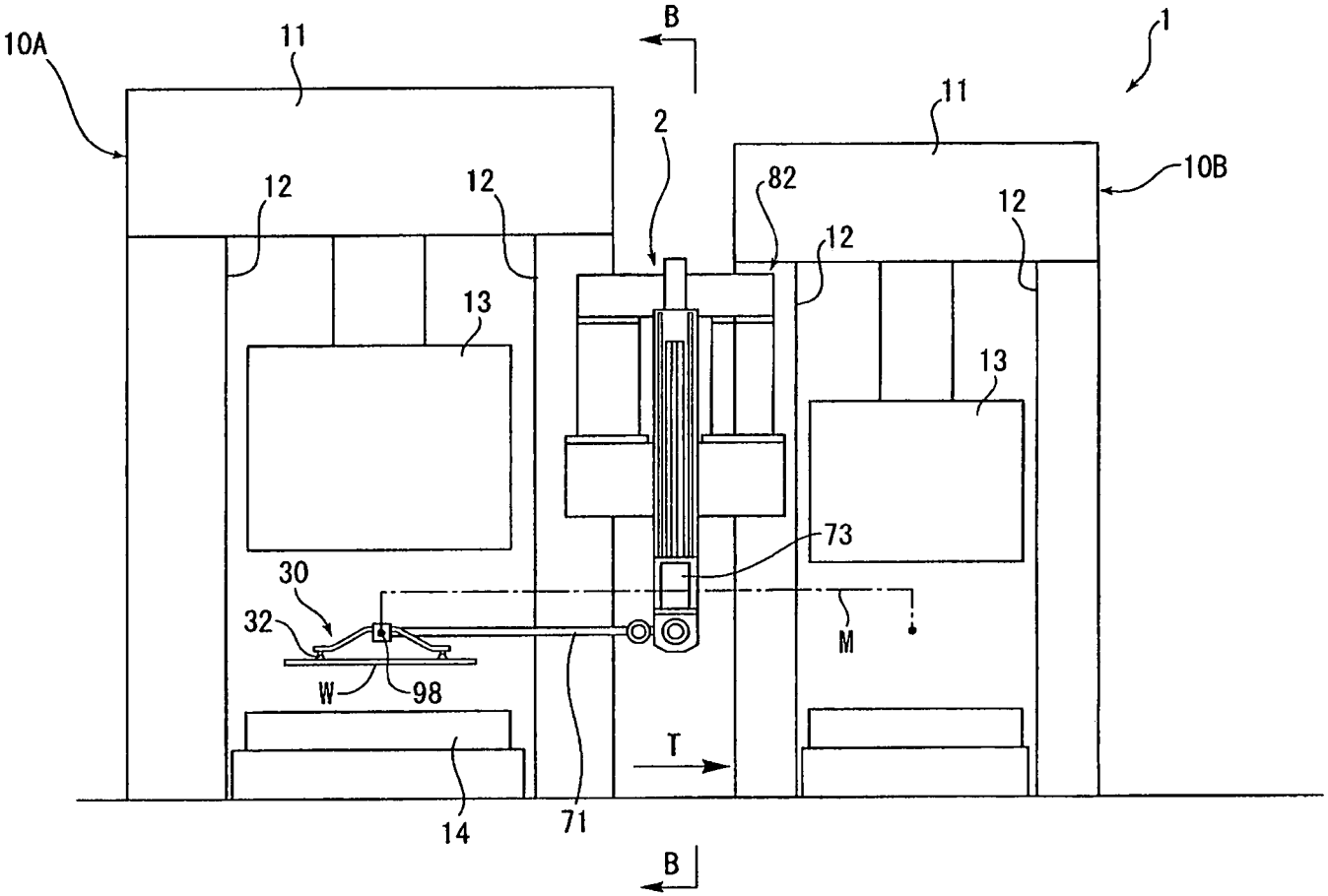
FIG. 9 is a view taken along the line A-A in FIG. 8.

FIG. 8 is a general flat view showing a tandem press line according to the fifth embodiment. FIG. 9 is a view taken along the line A-A in FIG. 8, while FIG. 10 is a view taken along the line B-B in FIG. 9.

In the tandem press line 1 according to the fifth embodiment, a plurality (two units in this embodiment) of pressing machines 10A, 10B are serially provided from the upstream side (left hand side in FIG. 8 and FIG. 9 respectively) to the downstream side (right hand side in FIG. 8 and FIG. 9 respectively) with a prespecified space therebetween. Further a support member 82 is provided at a prespecified height between the pressing machine 10A and pressing machine 10B. This support member 82 is fixed to the downstream side uprights 12, 12 of the pressing machine 10A as well as to the upstream side uprights 12, 12 of the pressing machine 10B via the brackets 81 respectively.

Figure 10:
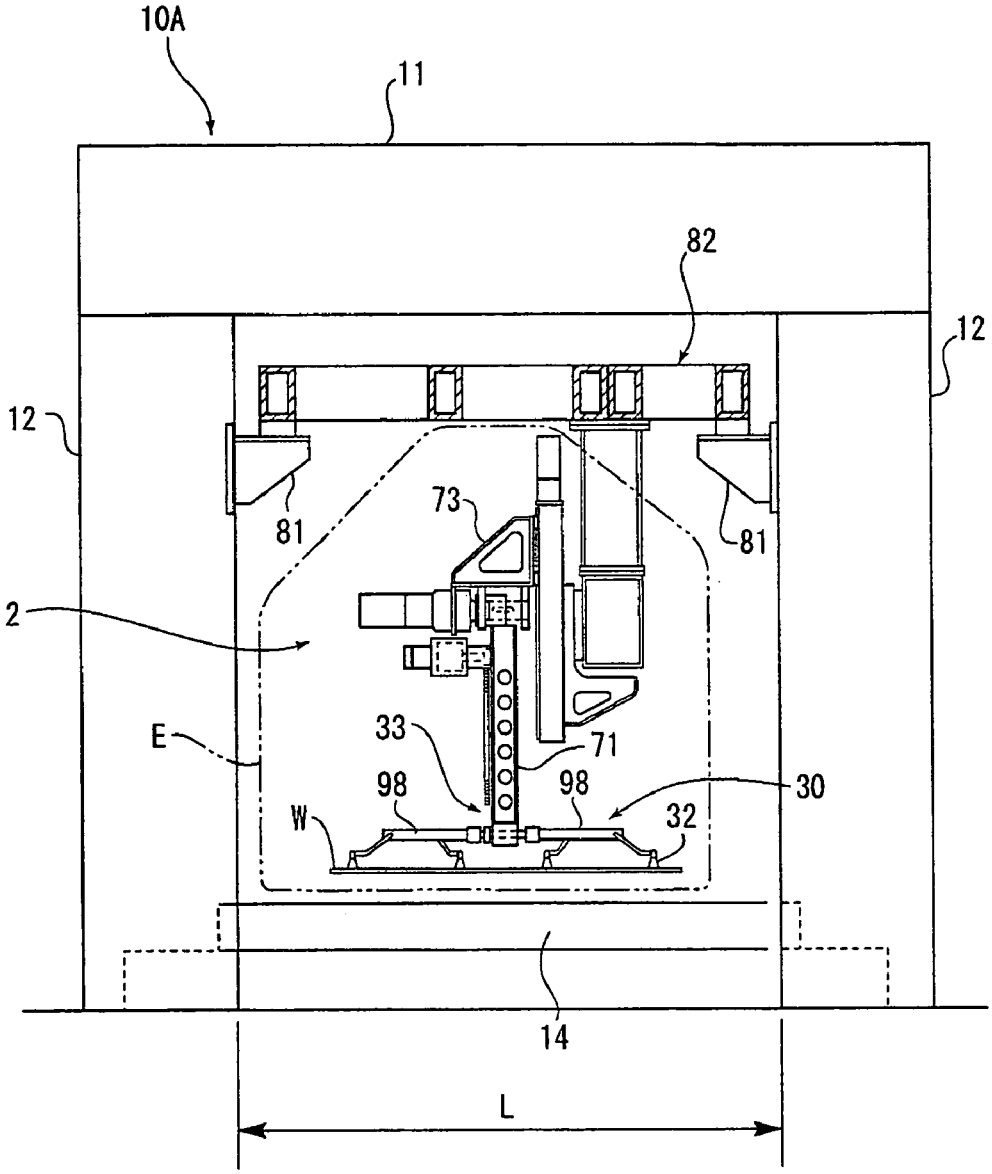
FIG. 10 is a view taken along the line B-B in FIG. 9.
Figure 11:
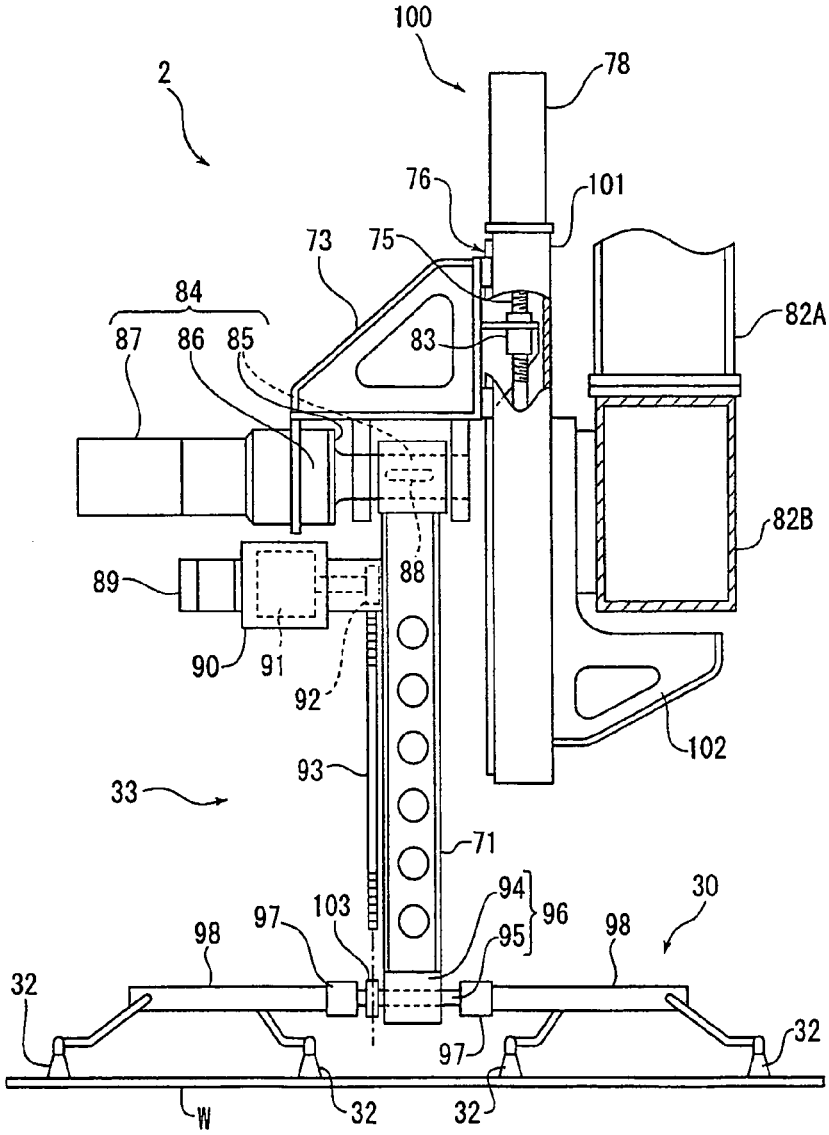
FIG. 11 is an enlarged view showing the section E in FIG. 10 for illustrating the structure of the work transfer device.

FIG. 11 is an enlarged view showing a section E in FIG. 10 for illustrating structure of the work transfer device 2.

In the work transfer device 2 described above, the support member 82 is positioned at an upper position between the adjoining pressing machines 10A, 10B to cause no trouble when a work is carried in or out therefrom and to prevent interference with each slide 13 and other components.

The support member 82 includes a beam 82B hung up by a member 82A, and a frame 101 is mounted via a bracket 102 on this beam 82B, and further a lift carrier 73 is mounted via a linear guide 76 on this frame 101. The lift carrier 73 can move up and down against the frame 101 being guided by the linear guide 76. Further this frame 101 includes a servo motor 78, a ball screw 75 coupled to an output shaft of this servo motor 78, and a ball nut 83 screwed into this ball screw 75 and also fixed to the lift carrier 73, and the lift carrier 73 moves up and down when driven and controlled by the servo motor 78. Thus the lift carrier 73 is moved up and down by a lifting mechanism (so-called the mono-axial ball screw slider mechanism) 100 including the linear guide 76, servo motor 78, ball screw 75, and ball nut 83.

A rotating shaft 85 is attached via a bearing device (not shown) to the lift carrier 73, and an arm (swinging body) 71 is fixed with a coupling unit such as a key 88 to this rotating shaft 85, so that the arm 71 can swing along the work transfer direction T around the rotating shaft 85 against the lift carrier 73. Further an output shaft of a servo motor 87 is coupled via a reducer 86 to the rotating shaft 85, and when driven and controlled by the servo motor 87, the arm 71 swings in the work transfer direction T. Thus, with a swinging mechanism 84 including the rotating shaft 85, reducer 86, and servo motor 87, the arm 71 is driven and swung along the work transfer direction T.

A cross bar 98 for supporting in the hanging state a work W via a required number of vacuum cup devices 32 each for dismountably supporting the work W is provided on the arm 71. Namely, a supporting device 96 including mainly a casing section 94 and a supporting shaft 95 provided via a bearing device (not shown) in the casing section 94 is provided at a tip section of the arm 71, and further the cross bar 98 is attached to the supporting shaft 95 via a coupling device 97. Herein the supporting device 96 has a swivel-joint function based on an air pressure, and the vacuum cup devices 32 are connected to a vacuum conduit not shown via the cross bar 98, coupling device 97, and supporting shaft 95.

Further provided on the arm 71 is the tilt mechanism 33 for tilting the work W in the vertical direction. This tilt mechanism 33 includes a servo motor 89 attached via a housing 90 to one side face of the arm 71 at a position close to the base end section thereof, a reducer 91 coupled to an output shaft of the servo motor 89, a pulley 92 with driving gears fixed to an output shaft of this reducer 91, a pulley 103 with driven gears fixed to the supporting shaft 95, and a timing belt 93 wound around between the pulley 92 with driving gears and the pulley 103 with driven gears, and when the cross bar 98 is driven by the servo motor 89 for rotation around the longitudinal axis thereof, the work W can be tilted in the vertical direction. In the fifth embodiment, the work W is tilted by the tilt mechanism 33 in the vertical direction to compensate inclination of the work W inevitably generated in association with the swinging movement of the arm 71. Thus as the work W is always kept in the horizontal posture, the work W can be carried into and out from the press machining position more smoothly and accurately.

An encoder (not shown) as a position detector for detecting a current height position of the lift carrier 73 is provided in the servo motor 78, and further an encoder (not shown) as a position detector for detecting a current inclination of the arm 71 and an encoder (not shown) as a position detector for detecting a current inclination of the cross bar 98 are provided in the servo motor 87 and in the servo motor 89 respectively, and position signals detected by the position detectors are inputted into a controller for the work transfer device.

The controller for the work transfer device outputs drive signals for having motion patterns of the cross bar 98 corresponding to needs in press machining to the servo motors 78, 87, and 89 respectively based on the current position information inputted from the position detectors and current position information for the slides 13, 13 inputted from a press controller (not shown) for controlling operations of each of the pressing machines 10A, 10B.

In the fifth embodiment, a motion M (a trajectory indicated by the dot and dash line in FIG. 9) of the cross bar 98 is set so that, by controlling the up/down movement of the lift carrier 73 by the lifting mechanism 100 and the swinging movement of the arm 71 by the swinging mechanism 84, the work W is carried out at a press machining position in the previous step and is carried to a press machining position in the next step.

Then operations of the work transfer device 2 for carrying the work W into and out from press machining positions in the pressing machines 10A and 10B respectively are described with reference to FIG. 12A to FIG. 16B each for illustrating operations of the pressing machines 10A and 10B. It is to be noted that, in the following descriptions, the term "forward" indicates a direction from the pressing machine 10A in the upstream side to the pressing machine 10B in the downstream side, namely the work transfer direction T.

[Operations (1)]

Figure 12A:
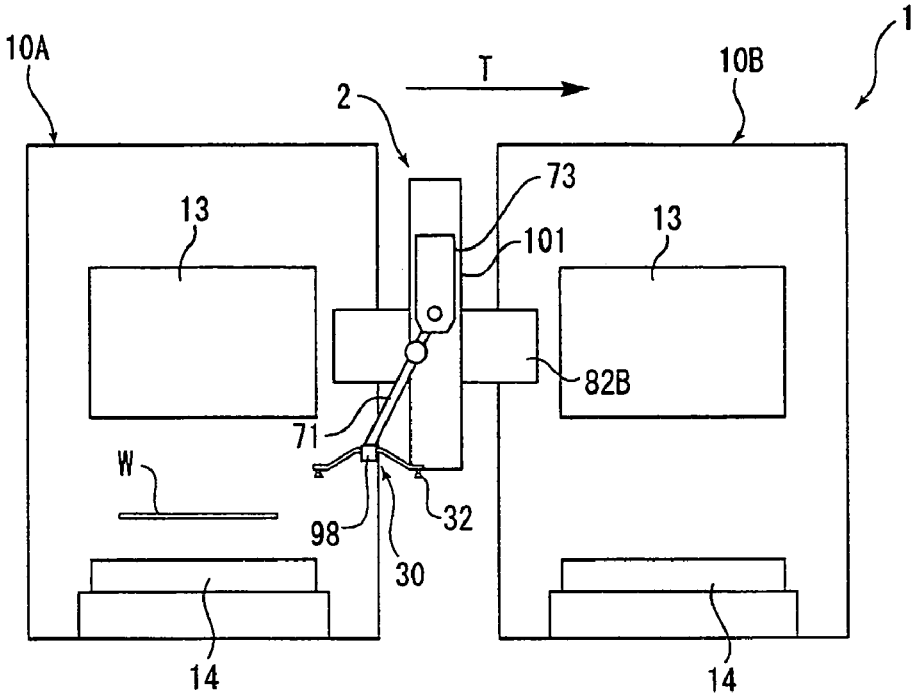
FIG. 12A and FIG. 12B are explanatory views (1) each illustrating an operation of the work transfer device.
Figure 12B:
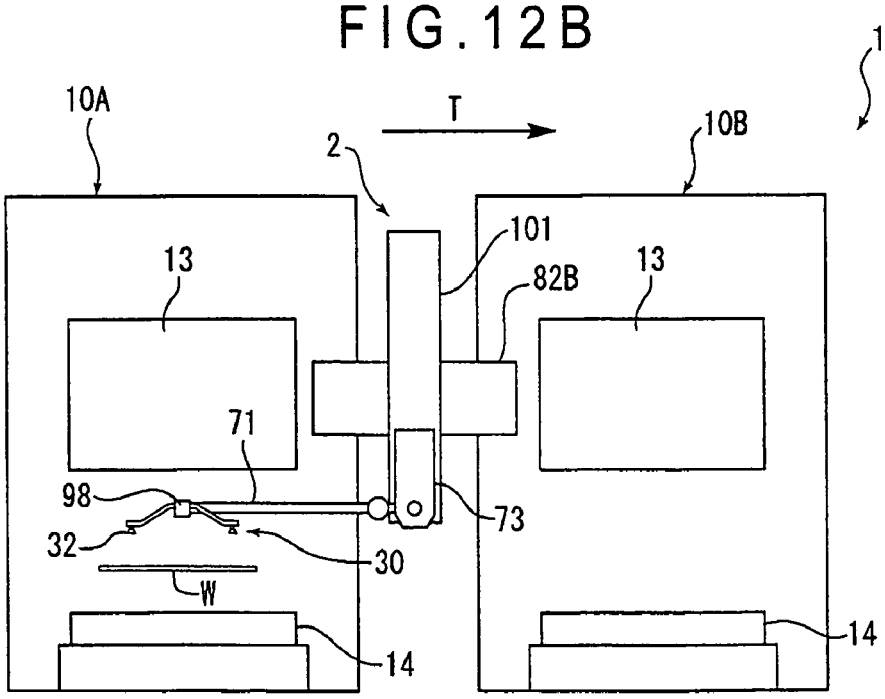

At first, from the state shown in FIG. 12A, by synthesizing the downward movement of the lift carrier 73 and clockwise rotational movement of the arm 71 in the figure to adjust the longitudinal direction of the arm 71 to the horizontal direction and then inserting the arm 71 into a space between the slide 13 and the moving bolster 14 in the pressing machine 10A suppressing interference with the die or other components, the cross bar 98 is moved toward the press machining position (Refer to FIG. 12B).

[Operations (2)]

Figure 13A:
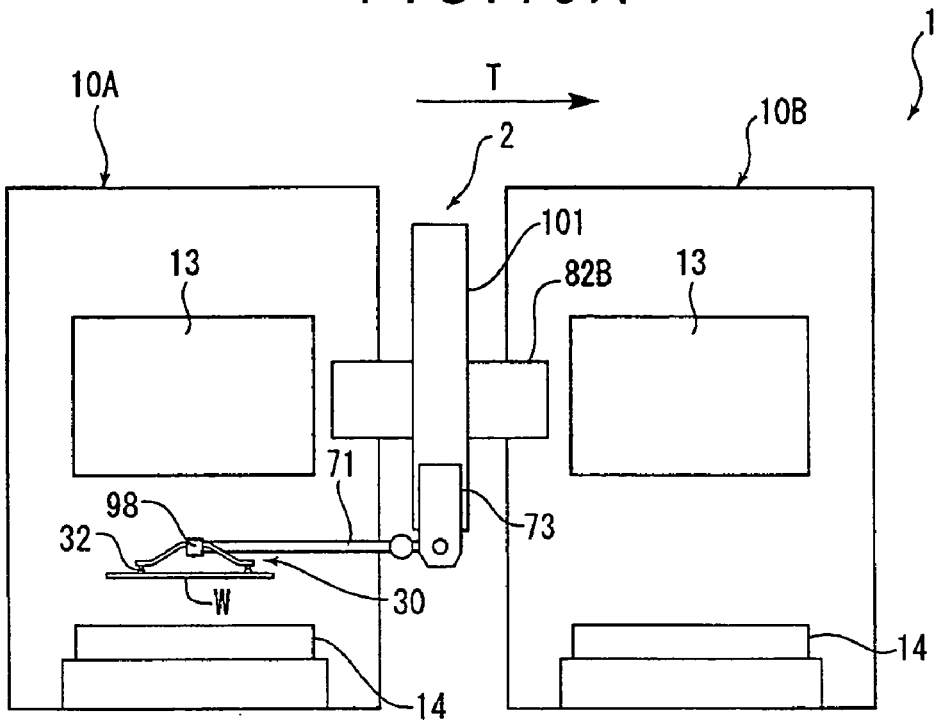
FIG. 13A and FIG. 13B are explanatory views (2) each illustrating an operation of the work transfer device.

Then by further moving downward the lift carrier 73 from the state shown in FIG. 12B, the cross bar 98 is moved downward in the vertical direction to a position where the vacuum cup device 32 is contacted by the work W so that the work W is sucked by the vacuum cup device 32 (Refer to FIG. 13A).

[Operation (3)]

Figure 13B:
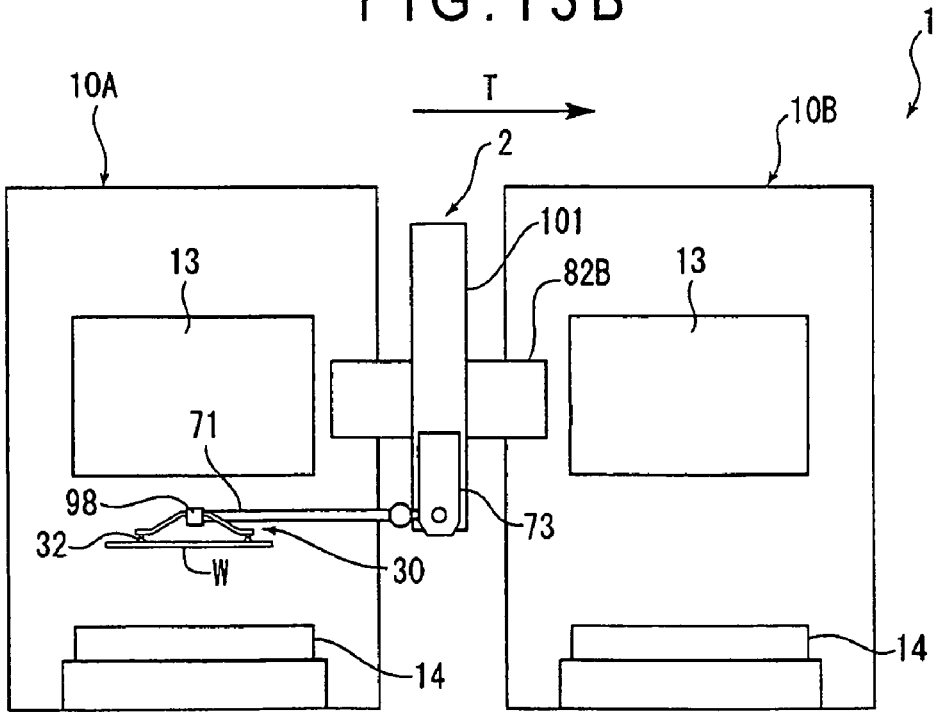

Then by moving upward the lift carrier 73 from the state shown in FIG. 13A, the cross bar 98 is moved upward in the vertical direction at a position where the work W goes off from the lower die of the pressing machine 10A, and then the work W is pulled upward from the lower die of the pressing machine 10A (Refer to FIG. 13B).

[Operation (4)]

Figure 14A:
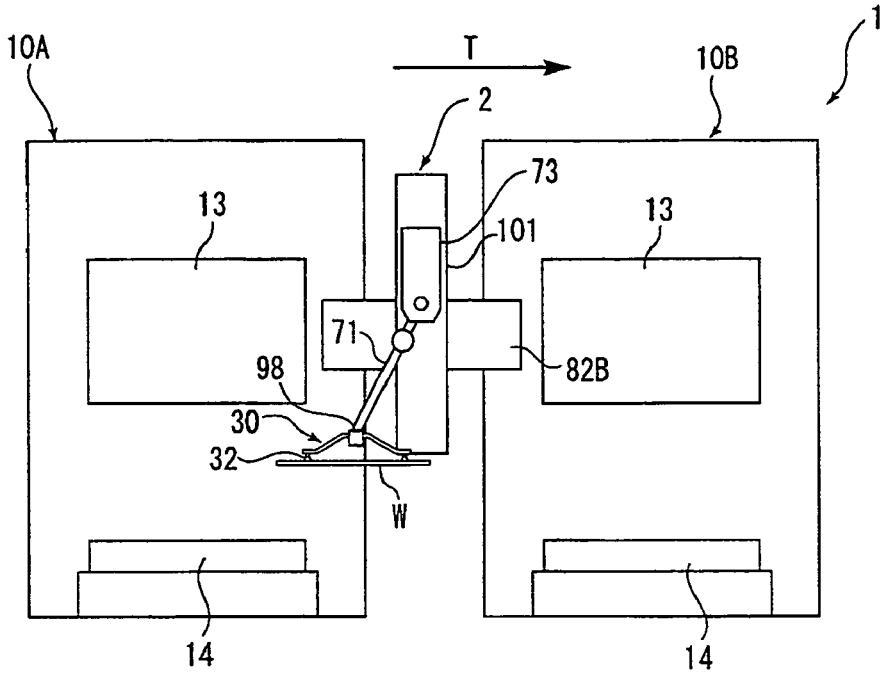
FIG. 14A and FIG. 14B are explanatory views (3) each illustrating an operation of the work transfer device.

Then by synthesizing the upward movement of the lift carrier 73 and counterclockwise rotational movement of the arm 71 in the figure each from the state shown in FIG. 13B, the cross bar 98 is moved forward in the horizontal direction to pull the work W off from the press machining position (Refer to FIG. 14A).

[Operation (5)]

Figure 14B:
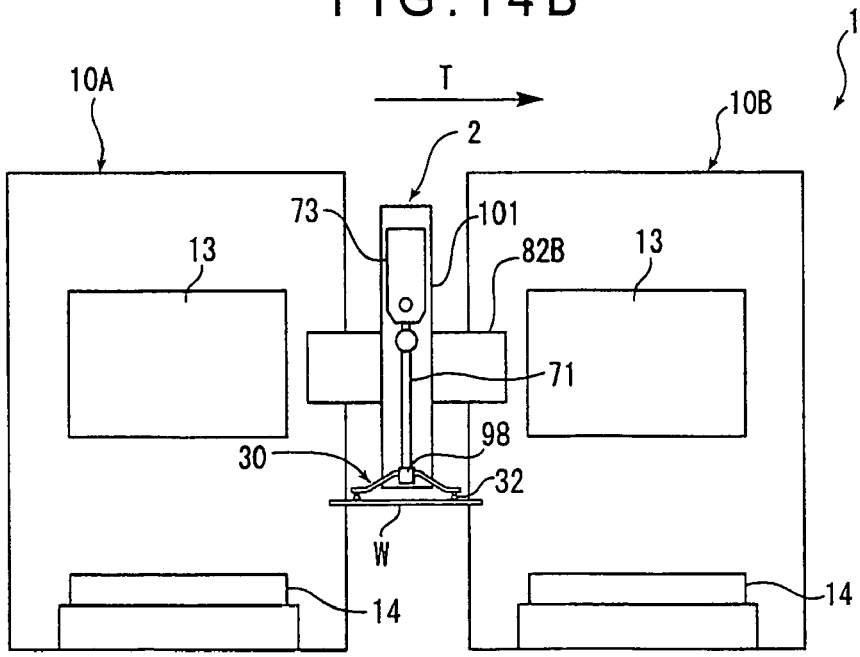

Then by synthesizing the upward movement of the lift carrier 73 and counterclockwise movement of the arm 71 in the figure each from the state shown in FIG. 14A, the work W is moved forward toward the pressing machine 10B (Refer to FIG. 14B).

[Operation (6)]

Figure 15A:
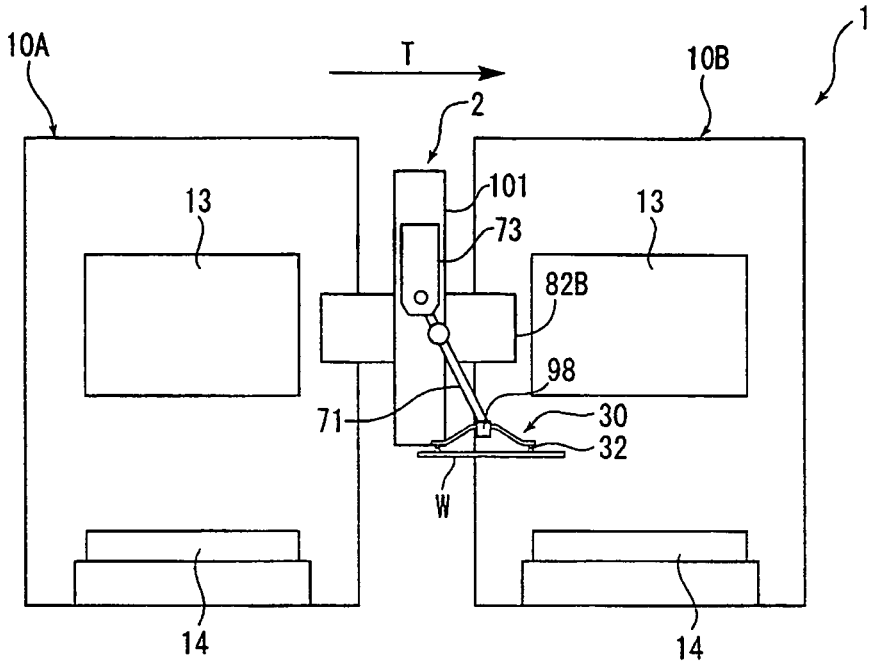
FIG. 15A and FIG. 15B are explanatory views (4) each illustrating an operation of the work transfer device.

Then by synthesizing the downward movement of the lift carrier 73 and counterclockwise rotational movement of the arm 71 in the figure each from the state shown in FIG. 14B, the work W is further moved forward toward the pressing machine 10B (Refer to FIG. 15A).

[Operation (7)]

Figure 15B:
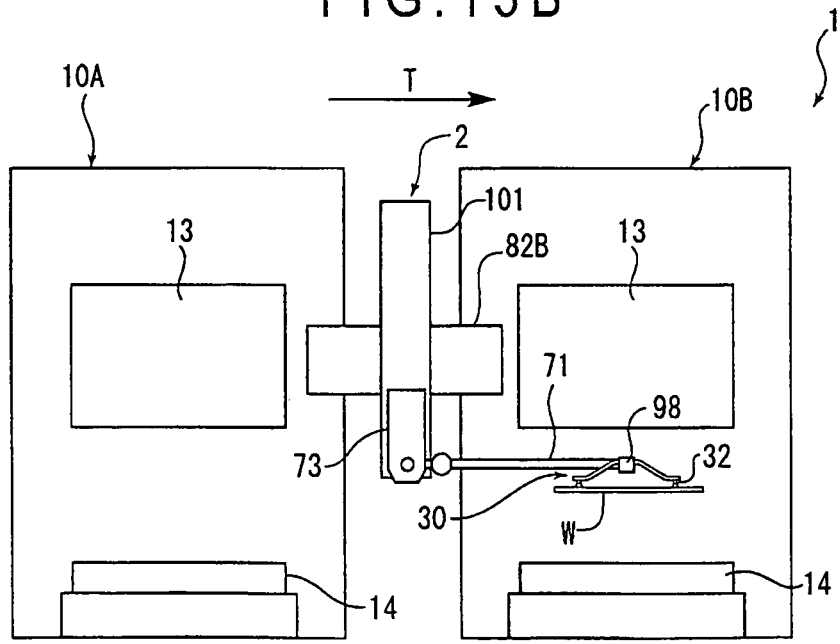

Then by synthesizing the downward movement of the lift carrier 73 and the counterclockwise rotational movement of the arm 71 in the figure each from the state shown in FIG. 15A to adjust the longitudinal direction of the arm 71 to the horizontal direction and then inserting the arm 71 into a space between the slide 13 and the moving bolster 14 in the pressing machine 10B suppressing interference with the die or other components, the cross bar 98 is moved toward the press machining position (Refer to FIG. 15B).

[Operation (8)]

Figure 16A:
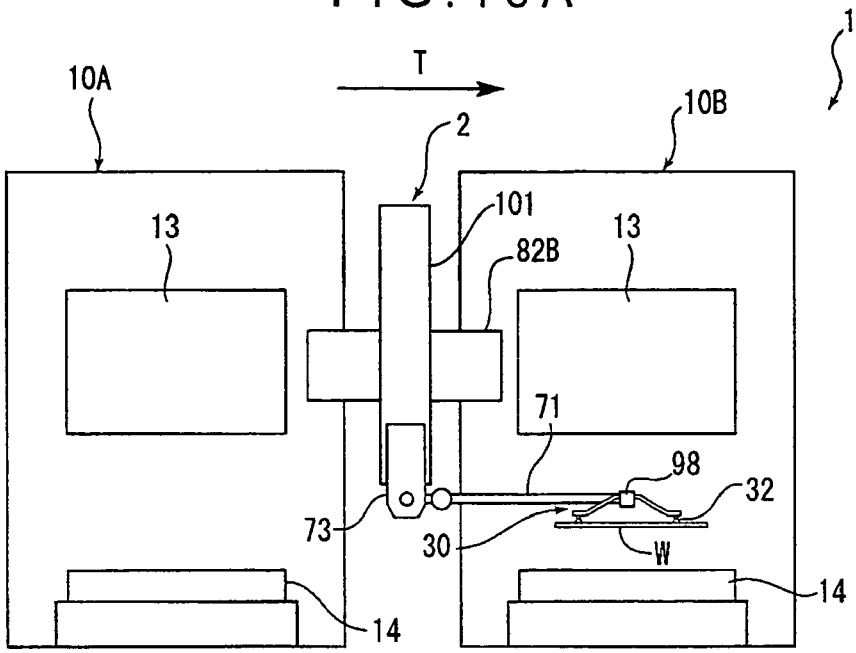
FIG. 16A and FIG. 16B are explanatory views (5) each illustrating an operation of the work transfer device.
Figure 16B:
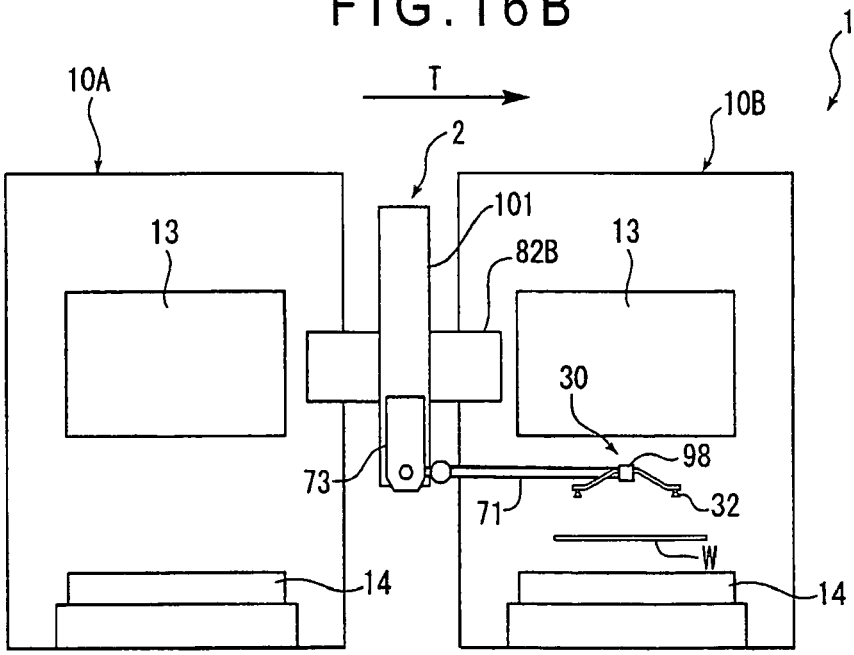

Then by further moving the lift carrier 73 downward from the state shown in FIG. 15B, the cross bar 98 is moved downward in the vertical direction to a position where the work W is set in the lower die of the pressing machine 10B (Refer to FIG. 16B).

Then the work W is released from the vacuum cup device 32 and operations reverse to the operation (8) above to effect the state as shown in FIG. 15B, and further the operations reverse to the operation (7), operation (6) and operation (5) are carried out in succession to restore the state shown in FIG. 12A, thus operations in one cycle being terminated. By repeating this operation cycle, the work W is sequentially transferred from the pressing machine 10A to the pressing machine 10B.

In the operation (1) and operation (2) described above, the cross bar 98 is driven for rotation around the longitudinal axis by the tilt mechanism 33 so that a sucking end face of the vacuum cup device 32 will be in the horizontal state. Further in each operation of the operations (3) to (8), the work W is tilted by the tilt mechanism 33 in the vertical direction so that an inclination of the work W inevitably generated in association with rotation of the arm 71, so that the work W is maintained in the horizontal posture.

With the fifth embodiment as described above, the following advantages are provided.

(14) Namely, as weights of movable portions (inertial loads) borne by the lifting mechanism 100 and the swinging mechanism 84 can be made smaller, size reduction and simplification of the devise configuration are possible with the cost reduced, and further by raising the work transfer speed, the production efficiency can be improved. Further as a movable area for the cross bar 98 can be made larger by synthesizing the upward movement of the lift carrier 73 and the swinging movement of the arm 71, the work W can be carried into and out from a press machining position without extending the beam or other components up to an area to which a die is carried in or out from. Because of this configuration, different from the conventional technology, it is not required to once raise the beam up to outside of the area to which a die is carried in or out from when the die is exchanged with a new one, and a period of time required for die exchange can be shortened, which also allows further improvement in the production efficiency.

(15) Further motions of the cross bar 98 can freely be set by controlling the lifting mechanism 100 and the swinging mechanism 84 respectively. Therefore motions M of the cross bar 98 can be set so that, as described above in relation to the operations, the cross bar 98 can be moved toward a press machining position by inserting only the arm 71 foe preventing interference with the die or other components and without allowing insertion of the lifting mechanism 100 and the swinging mechanism 84 into a space between the slide 13 and the moving bolster 14 when the work W is carried into or out from a press machining position. Because of this feature, it is not required, for instance, to excessively widen a clearance between uprights (front opening dimension: width indicated by sign L in FIG. 10) for securing a space for allowing insertion of the lifting mechanism 100 and the swinging mechanism 84 between right and left ends of the slide 13 and an inner side face of the uprights 12, and therefore the present invention can provide a work transfer device which can advantageously be used to reformation (retrofitting) of a pressing machine already having been installed in which the clearance between uprights can not be changed. When the work transfer device 2 according to this embodiment is applied to a pressing machine newly installed, a main body portion of the newly installed pressed machine can be designed compact, so that the initial cost can advantageously be reduced.

(16) Further in the fifth embodiment, as the structure of the work transfer device 2 is simple and compact, so that the work transfer device 2 can be used even in a case where a clearance between the adjoining pressing machines 10A, 10B is narrow, and therefore, a client's demand for shortening the entire length of a tandem press line can fully be satisfied. Further between the adjoining pressing machines 10A, 10B, a work can directly be transferred from a press machining position on the pressing machine 10A to a press machining position in the press machine 10B.

In the fifth embodiment, the arm 71 is in the horizontal posture at a point of time when the work holder 30 is positioned at a press machining position in each of the pressing machines 10A, 10B, but the present invention is not limited to this configuration, and the arm 71 may be in the inclined posture. In this case, by adjusting the inclination of the arm 71 at this point of time, a position of the work holder 30 in the feed direction can be adjusted.

Figure 17:
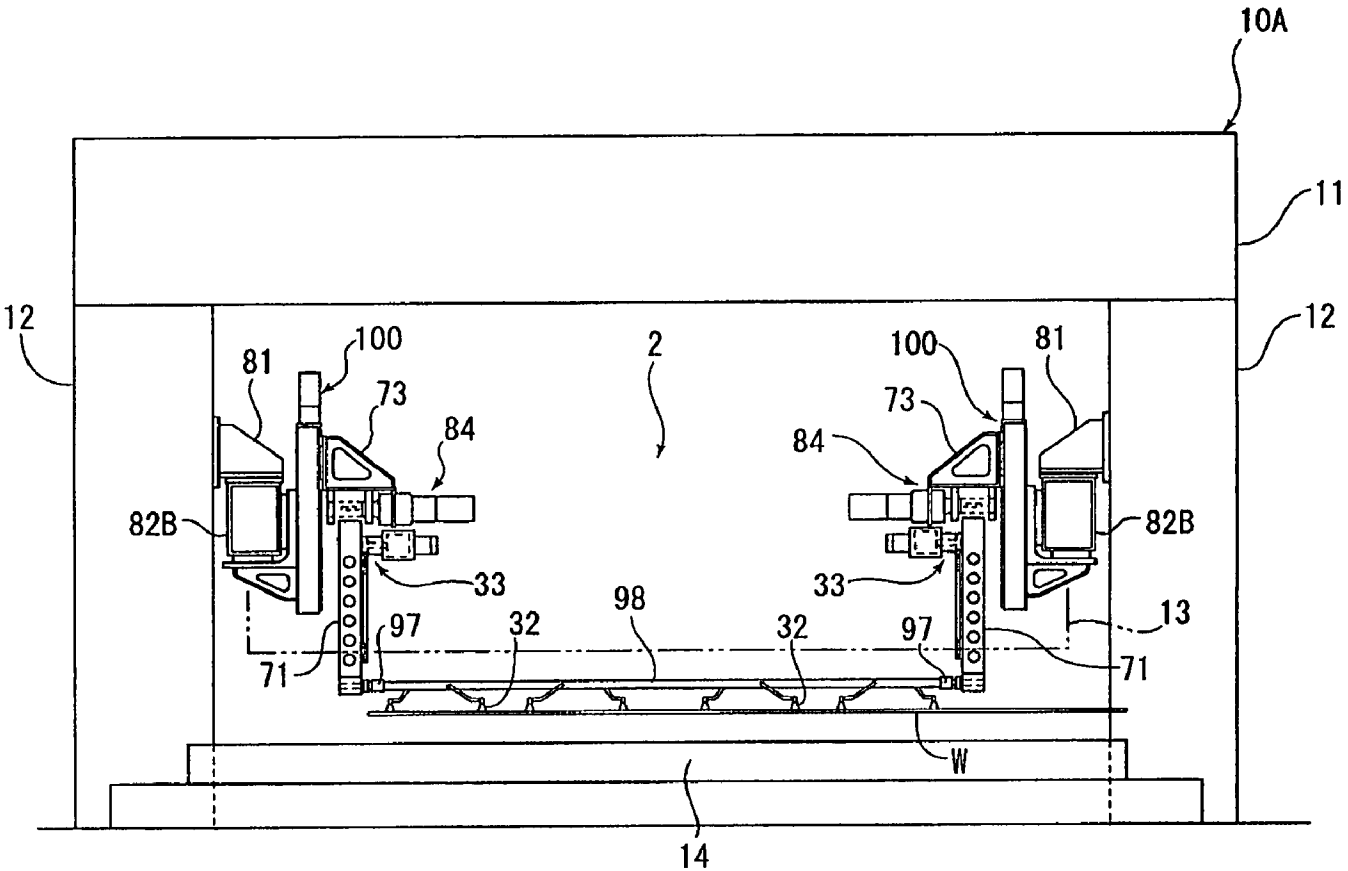
FIG. 17 is a view showing a work transfer device according to another aspect of a fifth embodiment.

Further in the fifth embodiment, the cantilever type of work transfer device 2 is described in which only one arm 71 spanned between the pressing machines 10A, 10B for supporting the cross bar 98 is provided to simplify the device configuration, but the present invention is not limited to this configuration, a center impeller type of work transfer device 2, as shown in FIG. 17 (the same numeral references are assigned in the figure to the components same as or similar to those in the fifth embodiment), may be employed in which two arms 71 are provided between the pressing machine 10A and a pressing machine positioned in the downstream side from the pressing machine 10A (not shown) for supporting the cross bar 98. This center impeller type of work transfer device 2 is advantageously employed, for instance, when the pressing machine 10A and other components are large.

Sixth Embodiment

This embodiment is for applying the present invention to a case where a clearance between pressing devices is large. This embodiment has the configuration similar to that of the fifth embodiment described above, but in this embodiment also reciprocal movement in the work transfer direction is also possible to respond to a case where a clearance between pressing machines is large.

Figure 18:
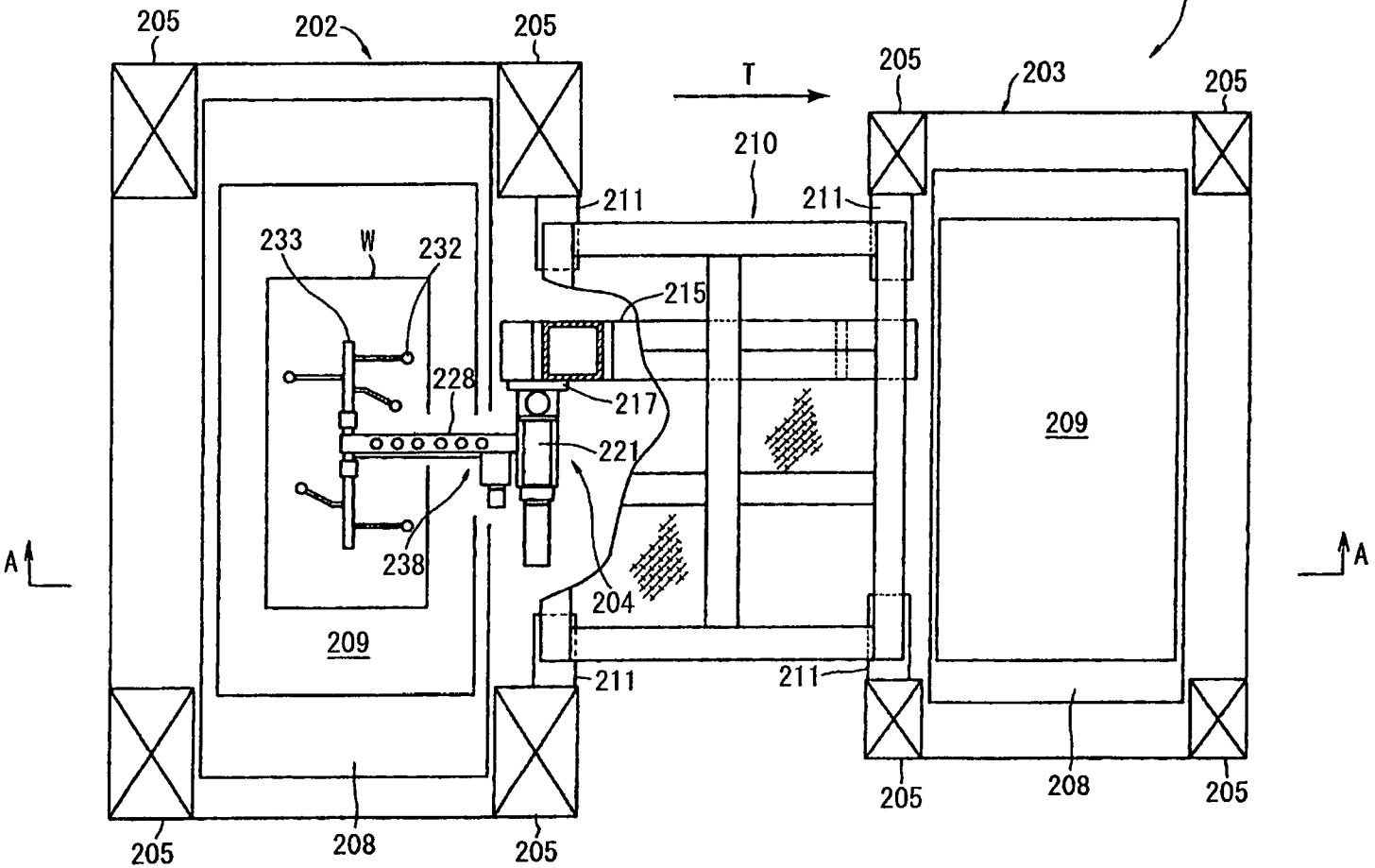
FIG. 18 is a general flat view showing a tandem press line according a sixth embodiment of the present invention.
Figure 19:
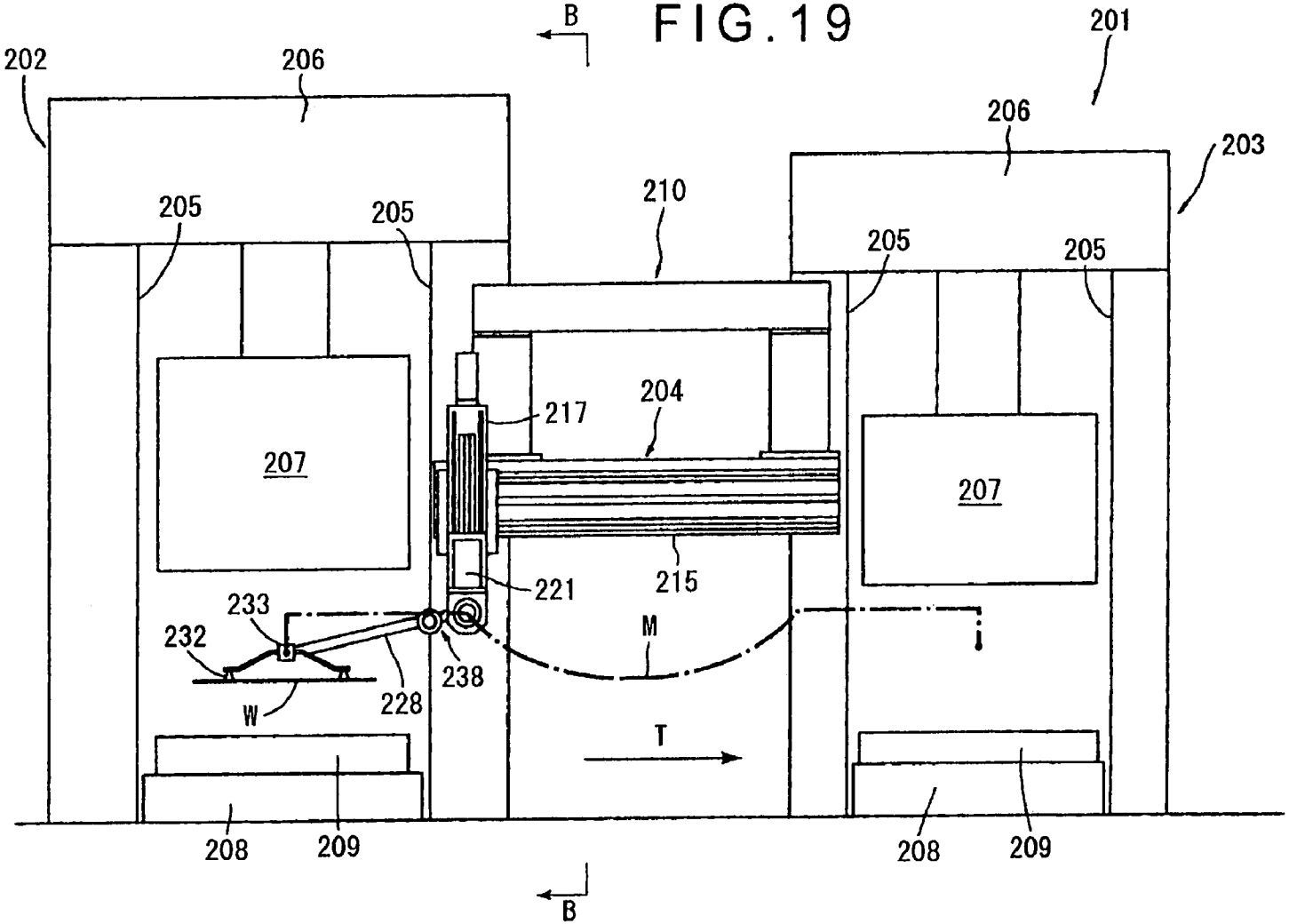
FIG. 19 is a view taken along the line A-A in FIG. 18.
Figure 20:
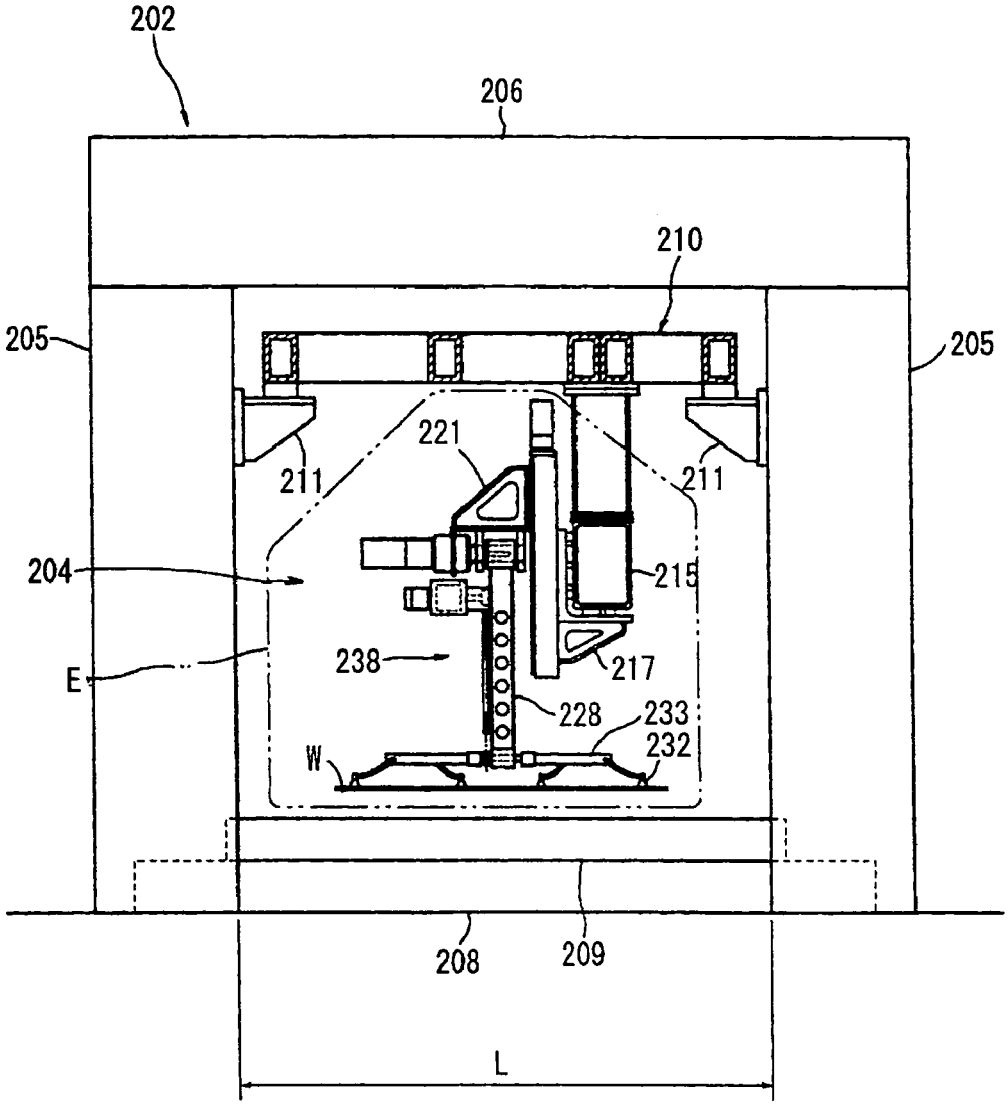
FIG. 20 is a view taken along the line B-B in FIG. 19.

FIG. 18 is a general flat view showing a tandem press line according to the sixth embodiment of the present invention. FIG. 19 is a view taken along the line A-A in FIG. 18 and FIG. 20 is a view taken along the line B-B in FIG. 19.

A tandem press line 201 according to this embodiment includes a plurality of units (two units in this embodiment) of pressing machines 202, 203 serially provided from the upstream side (left hand side in FIG. 18 and in FIG. 19) to the downstream side (right hand side in *Fig.*18 and in FIG. 19) with a prespecified clearance therebetween, a feed carry-in device (not shown) provided in the upstream side from the pressing machine 202 in the upstream side, a product carry-out device (not shown) provided in the downstream side from the pressing machine 203 in the downstream side, a work transfer device (not shown and having the same configuration as that of a work transfer device 204 described hereinafter) for transferring a work on the feed carry-in device to a machining station in the pressing machine 202 in the upstream side, a work transfer device 204 for delivering a work W between each of the machining stations in the adjoining pressing machines 202, 203 (carry-in/carry-out), and a work transfer device (not shown and having the same configuration as that of the work transfer device 204) for transferring the work from a machining station in the pressing machine in the downstream side onto the product carry-out device.

Each of the pressing machines 202, 203 has an upright 205 as a main body frame, an upper frame 206 provided above this upright 205 with a driving force delivery mechanism incorporated therein, a slide 207 movably supported on the upright 205 in the vertical direction and capable of moving in the vertical direction via the driving force delivery mechanism, a moving bolster 209 provided on a bed 208 at a position opposite to the slide 207, an upper die (not shown) set on a lower end of the slide 207, and a lower die (not shown) set on an upper end of the bolster 209, and with the configuration as described above, each of the pressing machines 202, 203 carries out press machining to the work W.

Further a support frame 210 for supporting a beam 215 described later is provided at a prespecified height position between the pressing machine 202 and pressing machine 203. This support frame 210 is fixed to the upright 205 in the downstream side from the pressing machine 202 and to the upright 205 in the upstream side from the pressing machine 203 via the brackets 211 respectively.

Figure 21:
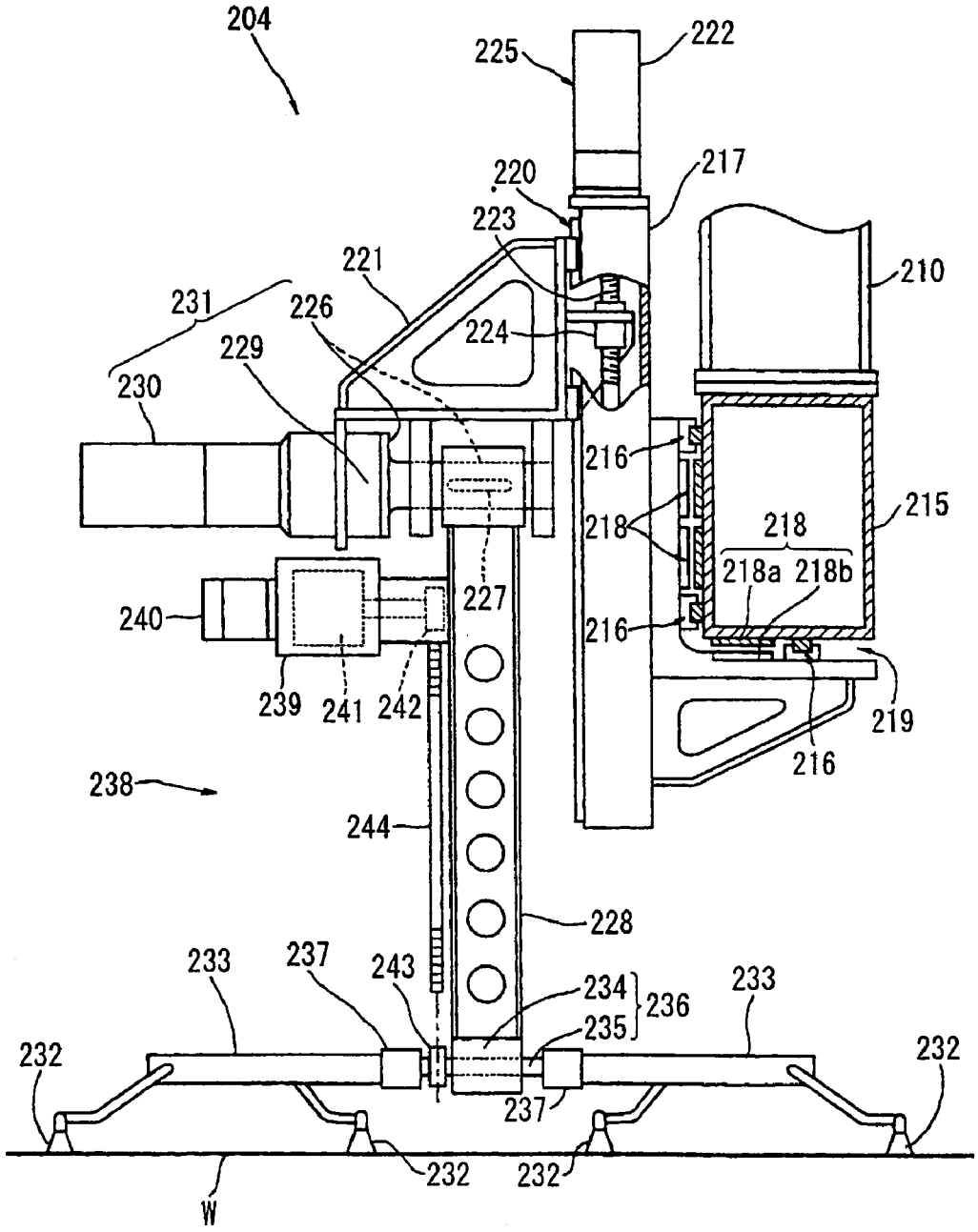
FIG. 21 is an enlarged view showing the section E in FIG. 20 for illustrating the structure of the work transfer device.

FIG. 21 is an enlarged view showing the section E in FIG. 20 for illustrating the structure of the work transfer device 204.

The work transfer device 204 includes a beam 215 spanned between the adjoining pressing machines 202, 203 along the work transfer direction T. This beam 215 is supported by the support frame 210 in the hanging state and is positioned at a fully high position not hampering the operations for carrying a work in and out and also not causing interference with each slide 207 or other related components.

A feed carrier 217 is mounted via a linear guide 216 on the beam 215, and the feed carrier 217 can move along the beam 215 (along the work transfer direction T) under guidance by the linear guide 216. Further a linear motor 218 for moving the feed carrier 217 along the beam 215 is provide between the beam 215 and the feed carrier 217. This linear motor 218 includes a magnet 218*a* attached to an outer side face of the beam 215, and a coil 218*b* attached to an inner side face of the feed carrier 217 opposing to this magnet 218*a*, and an armature having the coil 218*b* (feed carrier 217) linearly moves in response to change in a magnetic field generated on a stator (beam 215) having the magnet 218*a*. Thus the feed carrier 217 is moved along the beam 215 by a moving mechanism 219 including the linear guide 216 and the linear motor 218.

A lift carrier 221 is mounted via a linear guide 220 on the feed carrier 217, and the lift carrier 221 can move up and down against the feed carrier 217 under guidance by the linear guide 220. Further the feed carrier 217 includes a servo motor 222, a ball screw 223 coupled to an output shaft of the servo motor 222, and a ball nut 224 screwed onto the ball screw 223 and fixed to the lift carrier 221, and the lift carrier 221 moves up and down when driven by the servo motor 222 under control thereby. Thus the lift carrier 221 is moved up and down by the lifting mechanism 225 (the so-called mono-axial ball slider mechanism) including the linear guide 220, servo motor 222, ball screw 223, and ball nut 224.

A rotating shaft 226 is attached via a bearing device (not shown) to the lift carrier 221, and the arm (swinging body) 228 is fixed via a coupling unit such as a key 227 or the like to this rotating shaft 226, so that the arm 228 can swing around the rotating shaft 226 against the lift carrier 221 along the work transfer direction T. Further an output shaft of a servo motor 230 is coupled via a reducer 229 to the rotating shaft 226, and the arm 228 can swing along the work transfer direction T when driven by the servo motor 230 under control thereby. Thus the arm 228 is swung and driven along the work transfer direction T by the swinging mechanism 231 including the rotating shaft 226, reducer 229, and servo motor 230.

A cross bar 233 for supporting a work W in the hanging state via a prespecified number of vacuum cup devices (work holders) 32 each for dismountably holding the work W is provided on the arm 228. Namely a supporting device 236 mainly including a casing section 234 and a supporting shaft 235 provided via a bearing device (not shown) in the casing section 234 is provided at a tip section of the arm 228, and the cross bar 233 is attached via a coupling device 237 to the supporting shaft 235. The supporting device 236 has the swivel joint function based on an air pressure, and a vacuum cup 232 is connected to a vacuum conduit not shown via the cross bar 233, coupling device 237, and supporting device 236.

Provided in the arm 228 is a tilt mechanism 238 for tilting the work W in the vertical direction. This tilt mechanism 238 includes a servo motor 240 attached via the housing 39 to a side face of the arm 228 at a position close to a base section thereof, a reducer 241 coupled to an output shaft of this servo motor 240, a pulley 242 with driving gears fixed to an output shaft of this reducer 241, a pulley 243 with driven gears fixed to the supporting shaft 235, and a timing belt 244 wound around the pulley 242 with driving gears and the pulley 243 with driven gears, and when the cross bar 233 is driven for rotation around the longitudinal axis when driven by the servo motor 240 under control thereby, the work W can be tilted in the vertical direction. In this embodiment, the work W is tiled by the tilt mechanism 238 in the vertical direction to compensate an inclination of the work W inevitably generated in association with the swinging movement of the arm 228. Thus by maintaining the horizontal posture of the work W, the operations for carrying the work W into and out from a press machining position can be carried out smoothly and accurately.

A linear scale (not shown) as a position detector for detecting a current position of the feed carrier 217 is provided between the beam 215 and the feed carrier 217, and a position signal detected by this position detector is inputted to a controller (not shown) for a work transfer device for controlling the work transfer device 204. Further an encoder (not shown) as a position detector for detecting a current height position of the lift carrier 221 is provided in the servo motor 222, and an encoder (not shown) as a position detector for detecting a current inclination angle of the arm 228 and an encoder (not shown) as a position detector for detecting a current inclination angle of the cross bar 233 are provided in the servo motor 230 and the servo motor 240 respectively, and the position signals detected by the position detectors are inputted to the controller for work transfer device. On the other hand, the controller for work transfer device outputs drive signals for execution of motion patterns of the cross bar 233 corresponding to conditions for press machining to each of the servo motors 222, 230, 240 and linear motor 218 based on the current position information inputted from the position detectors and a press controller (not shown) for controlling operations of the pressing machines 202, 203.

In this embodiment, a motion M of the cross bar 233 for carrying out a work W from a press machining position in the previous step and also for carrying this work W to a press machining position in the next step (as indicated by the trajectory shown by the dot and dash line in FIG. 19) is set, and the motion M is executed by controlling movement of the feed carrier 217 by the moving mechanism 219 in the work transfer direction, up and down movement of the lift carrier 221 by the lifting mechanism 225, and swinging movement of the arm 228 by the swinging mechanism 231.

Next operations of the work transfer device 204 for carrying the work W into and out from press machining positions in the pressing machine 202 and in the pressing machine 203 respectively with reference to the explanatory views for illustrating the operations in FIG. 22A to FIG. 26B. It is to be noted that the term "forward" in the following descriptions indicates a direction from the pressing machine 202 in the upstream side to the pressing machine 203 in the downstream side, namely the work transfer direction T.

[Operation (1)]

Figure 22A:
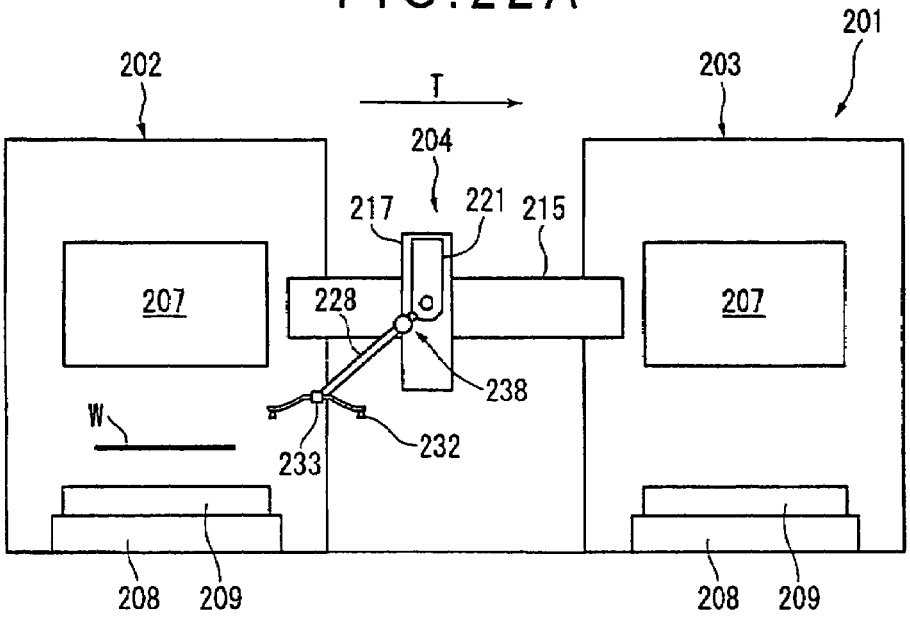
FIG. 22A and FIG. 22B are explanatory views (1) each illustrating an operation of the work transfer device.
Figure 22B:
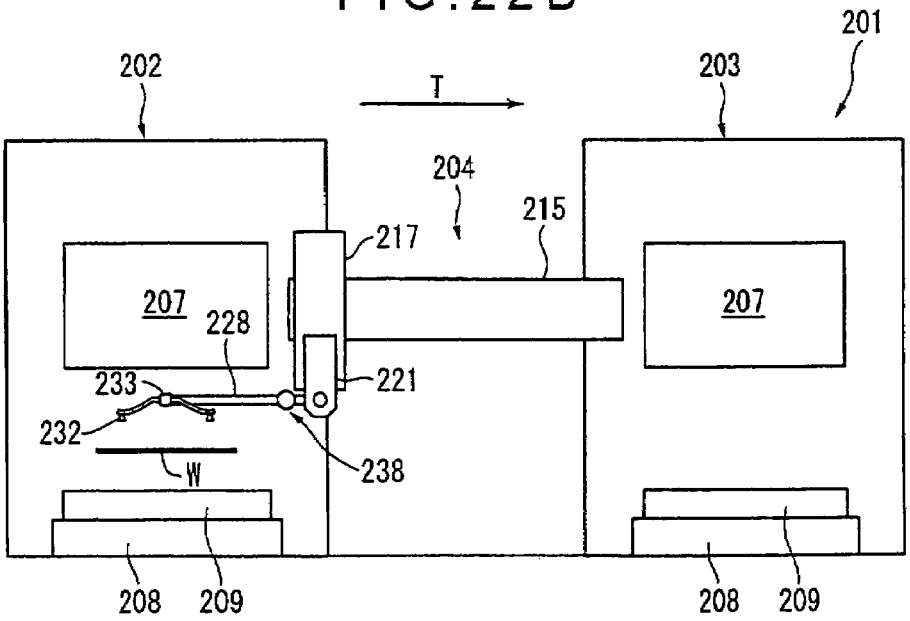

At first in the state shown in FIG. 22A, by synthesizing the backward movement of the feed carrier 217, downward movement of the lift carrier 221, and clockwise rotation of the arm 228 in the figure, the longitudinal direction of the arm 228 is adjusted to the horizontal direction, and then the arm 228 is inserted into a space between the slide 207 and bolster 209 in the pressing machine 202 suppressing interference with the die and other related components to move the cross bar 233 toward a press machining position (Refer to FIG. 22B).

[Operation (2)]

Figure 23A:
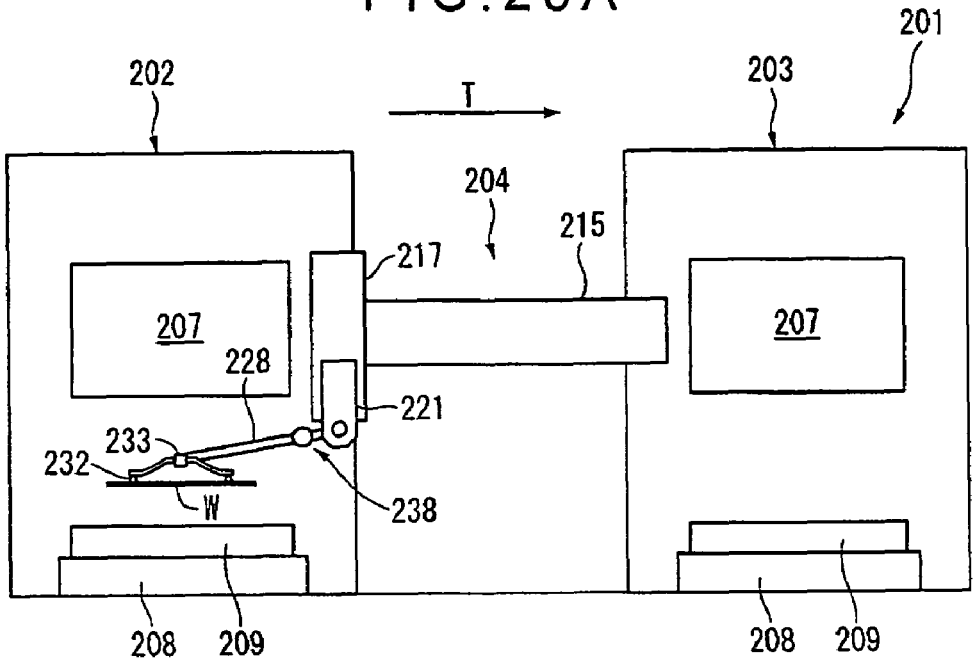
FIG. 23A and FIG. 23B are explanatory views (2) each illustrating an operation of the work transfer device.

Then in the state shown in FIG. 22B, by slightly moving backward the feed carrier 217 and rotating the arm 228 counterclockwise in the figure, the cross bar 233 is moved downward in the vertical direction to a position where the vacuum cup 232 contacts the work W to suck the work W with the vacuum cup 232 (Refer to FIG. 23A).

[Operation (3)]

Figure 23B:
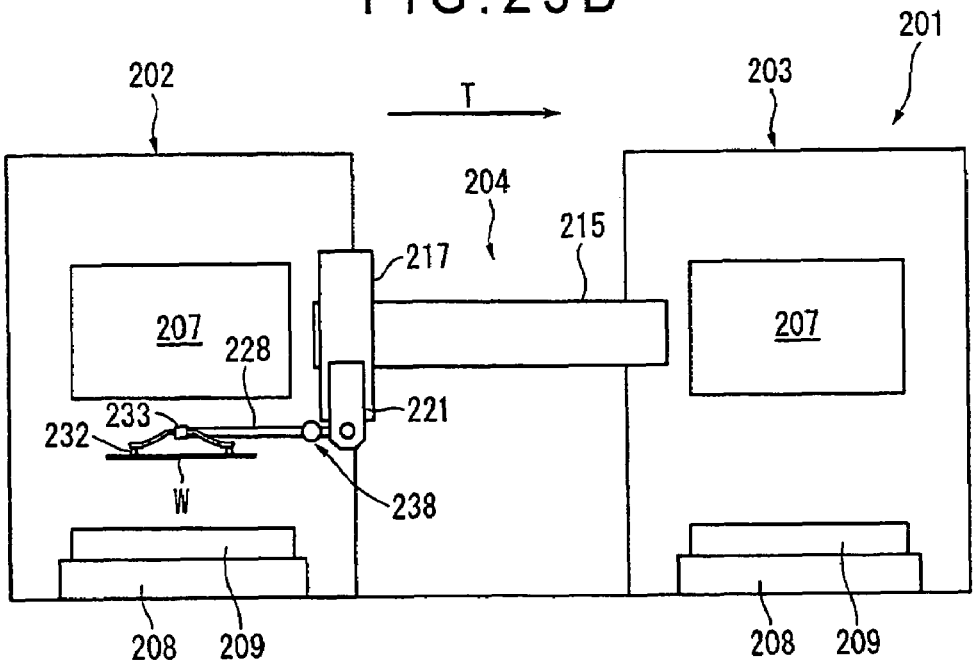

Then in the state shown in FIG. 23A, by slightly moving forward the feed carrier 217 and rotating the arm 228 clockwise in the figure, the cross bar 233 is moved upward to a position where the work W goes off from the lower die of the pressing machine 202, and the work W is pulled upward from the lower die of the pressing machine 202 (Refer to FIG. 23B).

[Operation (4)]

Figure 24A:
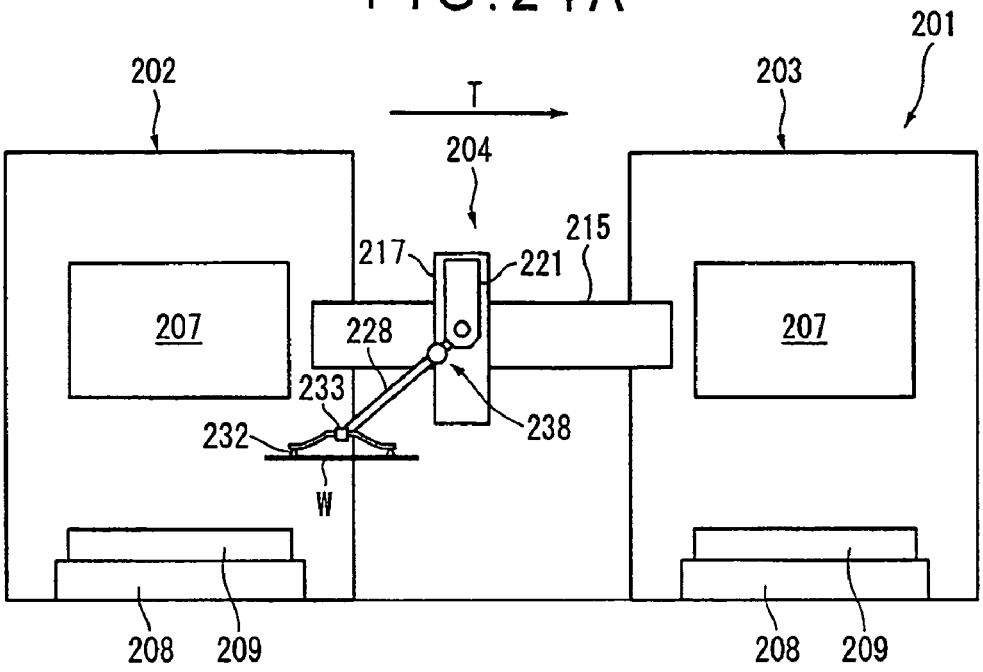
FIG. 24A and FIG. 24B are explanatory views (3) each illustrating an operation of the work transfer device.

Then in the state shown in FIG. 23B, by synthesizing forward movement of the feed carrier 217, upward movement of the lift carrier 221, and counterclockwise rotation of the arm 228 in the figure, the cross bar 233 is moved forward in the horizontal posture to pull out the work W from the press machining position (Refer to FIG. 24A).

[Operation (5)]

Figure 24B:
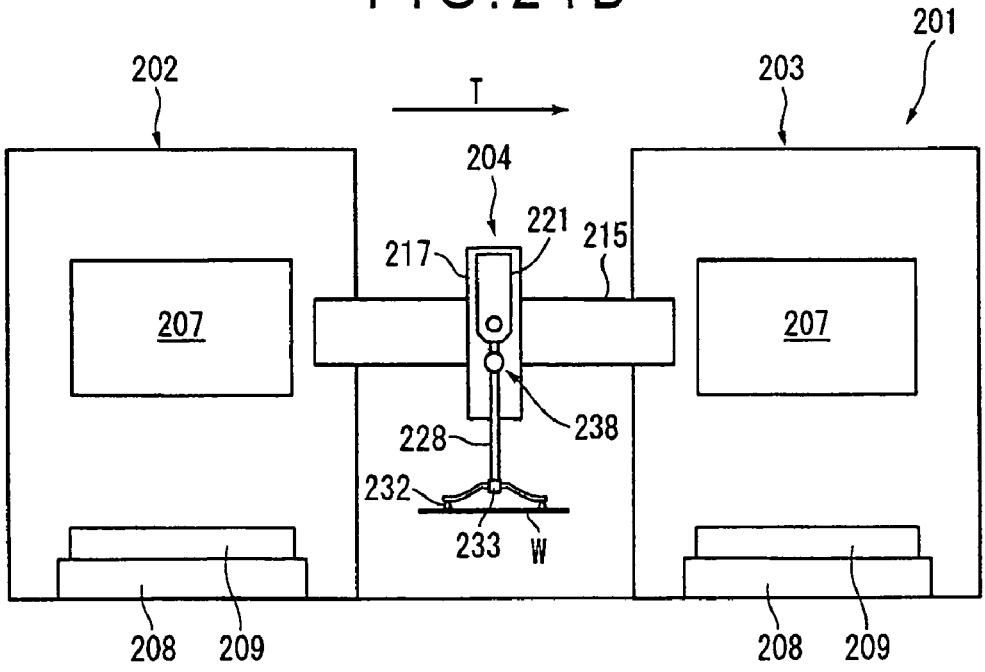

In the state shown in FIG. 24A, by synthesizing forward movement of the feed carrier 217 and counterclockwise rotation of the arm 228 in the figure, the work W is moved forward toward the pressing machine 203 (Refer to FIG. 24B).

[Operations (6)]

Figure 25A:
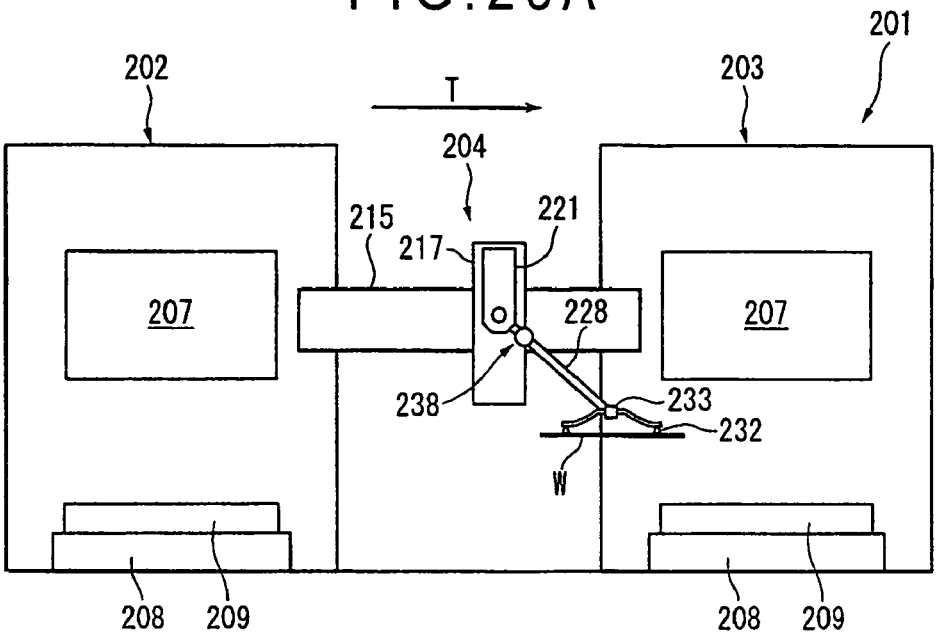
FIG. 25A and FIG. 25B are explanatory views (4) each illustrating an operation of the work transfer device.

Then in the state shown in FIG. 24B, by synthesizing forward movement of the feed carrier 217 and counterclockwise rotation of the arm 228 in the figure, the work W is further moved forward toward the pressing machine 203 (Refer to FIG. 25A).

[Operation (7)]

Figure 25B:
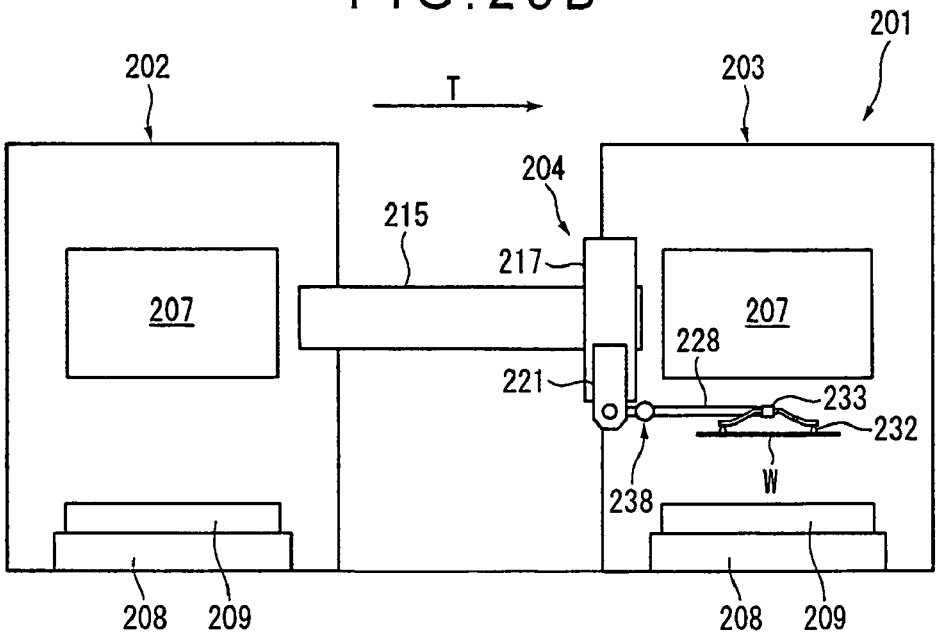

Then in the state shown in FIG. 25A, by synthesizing forward movement of the feed carrier 217, downward movement of the lift carrier 221, and counterclockwise rotation of the arm 228 in the figure, the longitudinal direction of the arm 228 is aligned to the horizontal direction, and the arm 228 is inserted into a space between the slide 207 and the bolster 209 in the pressing machine 203 suppressing interference with the die or other related components to move the cross bar 233 toward the press machining position (Refer to FIG. 25B).

[Operation (8)]

Figure 26A:
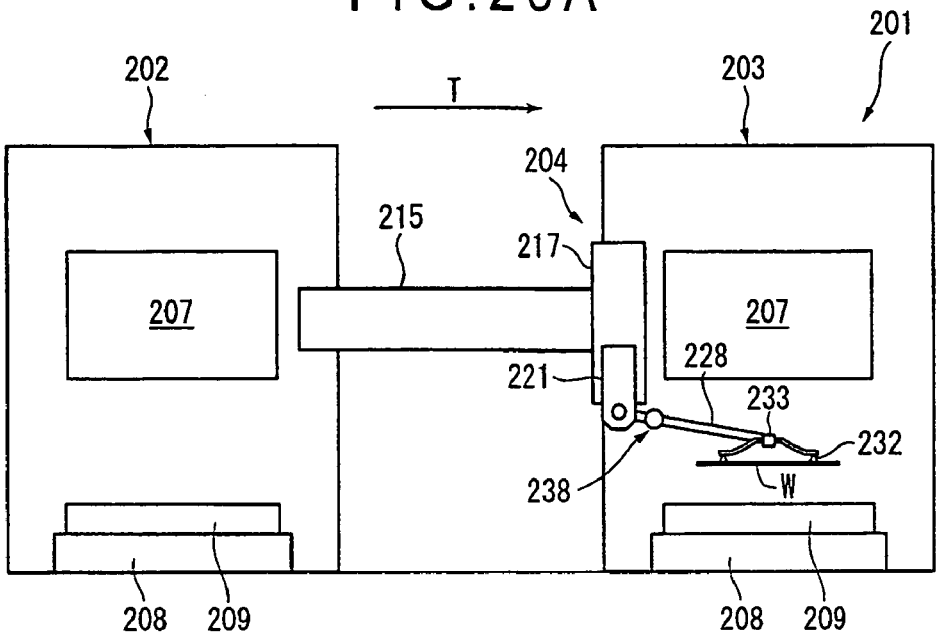
FIG. 26A and FIG. 26B are explanatory views (5) each illustrating an operation of the work transfer device.

Then in the state shown in FIG. 25B, by slightly moving forward the feed carrier 217 and also rotating the arm 228 clockwise in the figure, the cross bar 233 is moved downward in the vertical direction to a position where the work W is set in the lower die of the pressing machine 203 (Refer to FIG. 26A).

Figure 26B:
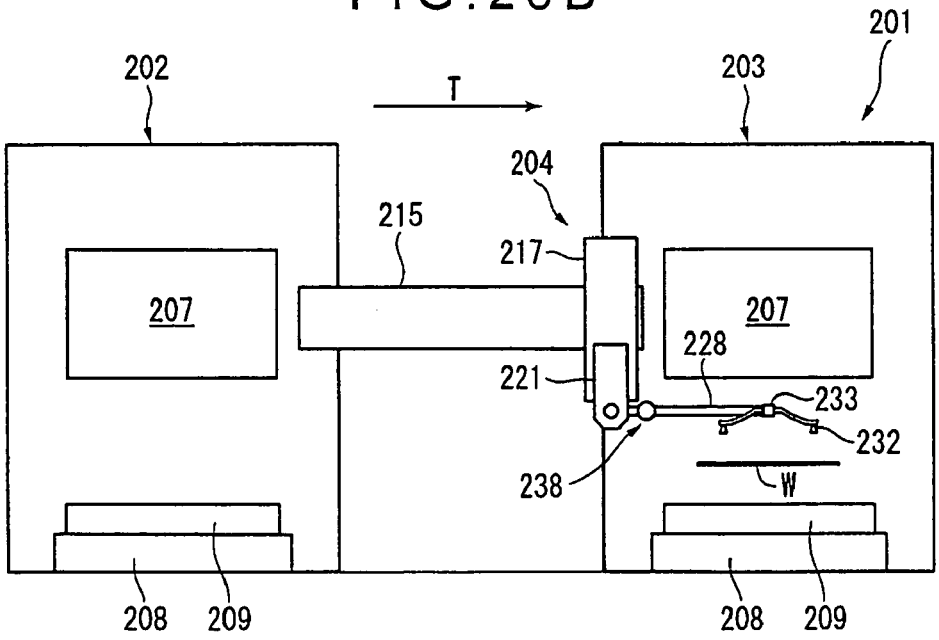

Then the work W is released from the vacuum cup 232, and the reverse operation to the operation (8) above is carried out to effect the state as shown in FIG. 26B, then reverse operations to the operation (7), operation (6), and operation (5) are carried out successively to return to the state shown in FIG. 22A, thus operations in one cycle being terminated. Subsequently by repeating this cycle, the work W is sequentially transferred from the pressing machine 202 to the pressing machine 203.

In the operation (1) and operation (2), the cross bar 233 is driven for rotation around the longitudinal axis by the tilt mechanism 238 so that a sucking end face of the vacuum cup 232 is horizontal. In each of the operations (3) to (8), the work W is tilted by the tilt mechanism 238 in the vertical direction to compensate the inclination of work W inevitably generated in association with rotation of the arm 228, so that the work is maintained in the horizontal posture.

With the embodiment as described above, as weights of movable bodies borne by the moving mechanism 219, lifting mechanism 225 and swinging mechanism 231 (inertial loads) can be set smaller, the device configuration can be down-sized and simplified with the cost reduced, and further the production efficiency can be improved by raising the work transfer speed. Further by synthesizing movement of the feed carrier 217 in the work transfer direction, up/down movement of the lift carrier 221, and swinging movement of the arm 228, a wide movable area can be secured for the cross bar 233, so that the work W can be carried in our out without the need of extending the beam 215 up to the carry-in/carry-out area for the die. Because of this feature, it is not necessary to once raise the beam up to outside of the area for carrying the die in and out when the die is to be exchanged with a new one, so that the time required for exchanging a die with a new one can be shortened, which also contributes to improvement in the production efficiency.

Further a motion of the cross bar 233 can freely be set by controlling the moving mechanism 219, lifting mechanism 225, and swinging mechanism 231 for driving. As described above in relation to the operations, a motion M of the cross bar 233 allowing for approach of the cross bar 233 to a press machining position by allowing intrusion of only the arm 228 for preventing interference with the die or the like and without allowing intrusion of the moving mechanism 219, lifting mechanism 225, and swinging mechanism 231 into a space between the slide 207 and the bolster 209 can be set when the work W is carried to or out from a press machining position. Because of this feature, it is not required, for instance, to excessively widen a clearance between uprights (front opening dimension: width indicated by the sign L in FIG. 20) for providing a space allowing for intrusion of the moving mechanism 219, lifting mechanism 225, and swinging mechanism 231 between right and left ends of the slide 207 and an inner side face of the upright 205, so that the present invention can provide a work transfer device which is advantageously used for reformation (retrofitting) already having been installed in which the upright clearance can not be changed. On the other hand, when the work transfer device 204 according to this embodiment is applied to a newly installed pressing machine, a main body portion of the newly installed pressing machine can be designed compact, which provides the advantage of reduction in the initial cost.

Figure 27:
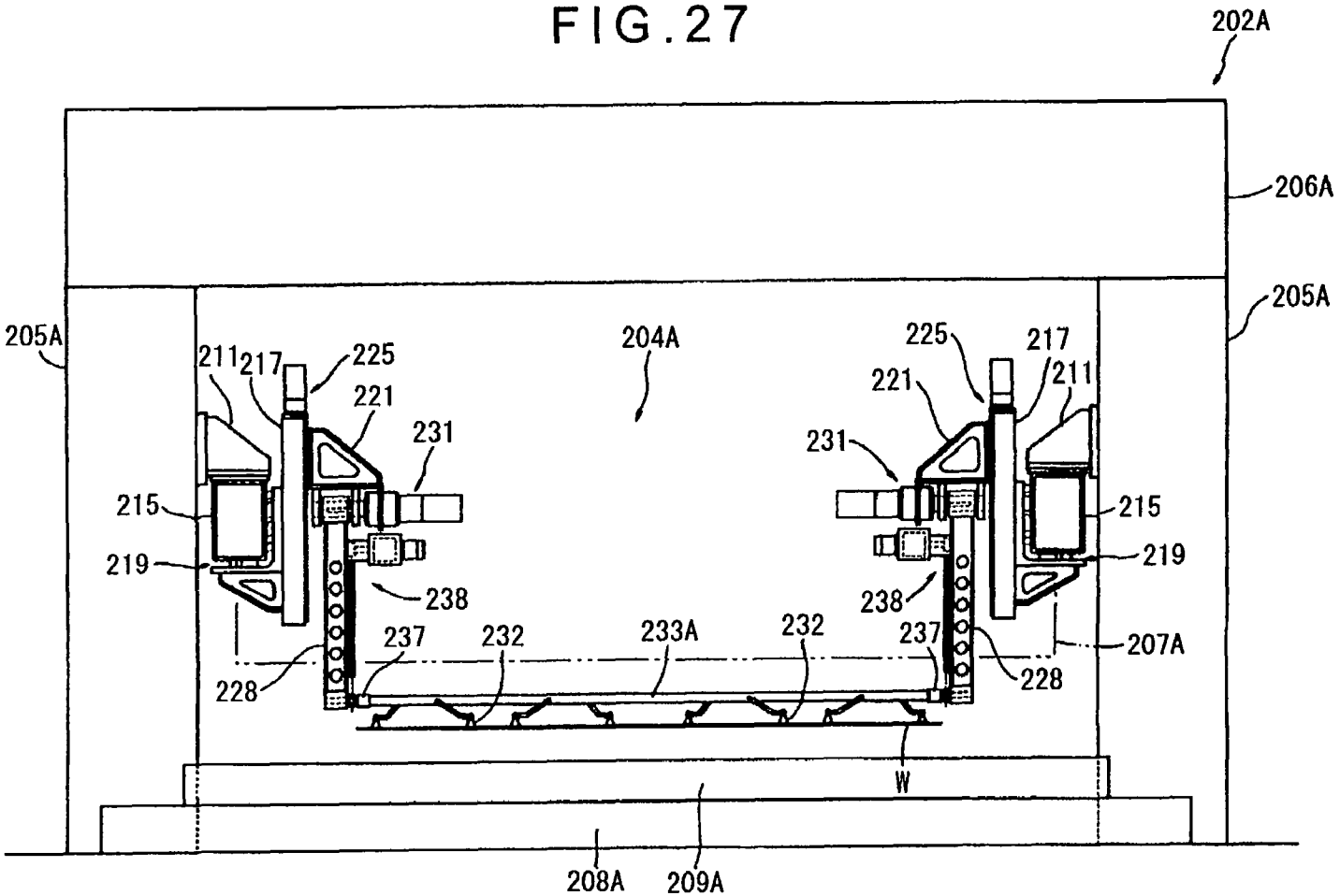
FIG. 27 is a view showing a work transfer device according to still another aspect.
Figure 28A:
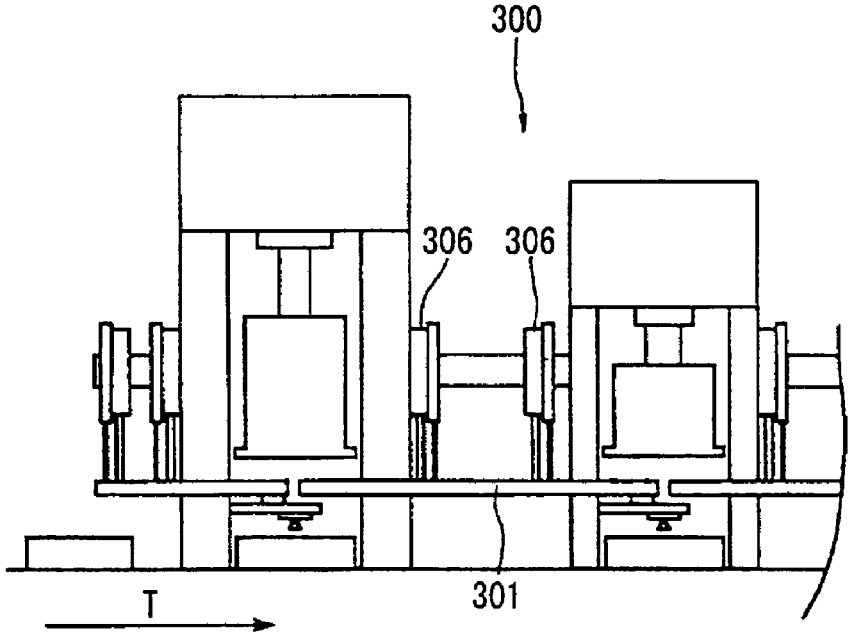
FIG. 28A PRIOR ART
FIG. 28A is a general front view showing a tandem press line based on the conventional technology.
Figure 28B:
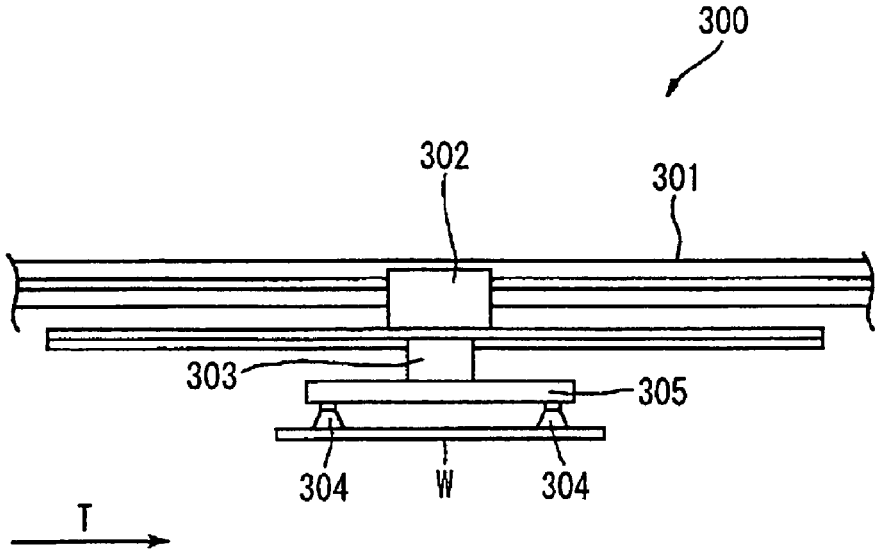
FIG. 28B PRIOR ART
FIG. 28B is an enlarged front view showing a key section of the work transfer device in FIG. 28A.

In this embodiment, the cantilever type of work transfer device 204 is described in which only one beam 215 is spanned between the pressing machines 202, 203 and only one arm 228 is used for supporting the cross bar 233 for simplifying the device configuration and also for further promotion of cost reduction, but the present invention is not limited to this configuration, and a center impeller type of work transfer device 204A may be employed in which two beams 215 are provided between a pressing machine 202A and a pressing machine positioned in the downstream side from the pressing machine 202A (not shown) and also two arms 228 are used for supporting a cross bar 233A, as shown in FIG. 27 (The same reference numbers are assigned to the components same as or similar to those in this embodiment). This center impeller type of work transfer device 204A is advantageously used, for instance, in a case where the pressing machine 202A or other related components are large.

[Modifications]

The present invention is not limited to the embodiments described above, and although the tandem press 1 in which the work transfer device 2 includes two units of pressing machines 10 (10A, 10B) is described in each of the embodiments 1 to 5, the present invention is not limited to this configuration, and the present invention may be applied to a tandem press line including three or more pressing machines.

Further in the sixth embodiment, the cantilever type of work transfer device 204 is described in which only one beam 215 is spanned between the pressing machines 202, 203 and only one arm 228 is used for supporting the cross bar 233 for simplifying the device configuration and also for further promotion of cost reduction, but the present invention is not limited to this configuration, and a center impeller type of work transfer device 204A may be employed in which two beams 215 are provided between the pressing machine 202A and a pressing machine positioned in the downstream side from the pressing machine 202A (not shown) and also two arms 228 are used for supporting the cross bar 233A, as shown in FIG. 27 (The same reference numbers are assigned to the components same as or similar to those in this embodiment). This center impeller type of work transfer device 204A is advantageously used, for instance, in a case where the pressing machine 202A or other related components are large.

The best configurations and methods for carrying out the present invention are disclosed above, but the present invention is not limited to the configurations and methods described above. Namely, although the present invention is illustrated and described in relation to specific embodiments above, various changes may be added by those skilled in the art in the forms, materials, quantities, and other detailed configurations employed in the embodiments described above without departing from the technological idea and a scope of the objects of the present invention.

Therefore, the configurations described above are only for the purpose of illustration to promote understanding of the present invention, and do not limit the present invention, so that descriptions using component names each lacking a portion or all of the limitations concerning the form or other factors used in descriptions of the embodiments above are included within a scope of the present invention.

The priority applications Numbers JP2004-022712 and JP2004-063825 upon which this patent application is based is hereby incorporated by reference.

What is claimed is:

1. A work transfer device for transferring a work between adjoining pressing machines along a work transfer direction, comprising:

a work holder for holding the work;

a beam provided between the pressing machines along the work transfer direction;

a feed carrier mounted on the beam and moved by a moving mechanism along the beam in the transfer direction;

a carrier provided between the adjoining pressing machines on the feed carrier and capable of being linearly moved in a direction orthogonal to the work transfer direction with a moving mechanism; and a swinging body with a swinging center shaft thereof provided on the carrier and capable of being driven for swinging by a swinging mechanism along the work transfer direction, wherein the work holder is provided in the swinging body.

2. The work transfer device according to claim 1, wherein a tilt mechanism is provided for driving the work holder for rotation around a shaft parallel to the swinging center shaft.

3. The work transfer device according to claim 1, further comprising:

a support member provided between the adjoining pressing machine, wherein the carrier is a lift carrier mounted on the support member and moved up and down by a lifting mechanism.

4. The work transfer device according to claim 3, further comprising:

a tilt mechanism for driving the work holder for rotation around a shaft parallel to the swinging center shaft.

5. The work transfer device according to claim 3, wherein a lower dead point is present on a swinging trajectory against the swinging center shaft of the swinging body.

6. The work transfer device according to claim 3, wherein one unit of the swinging body is provided between the adjoining pressing machines.

7. The work transfer device according to claim 1, wherein said carrier comprises a lift carrier mounted on the feed carrier and moved up and down by a lifting mechanism.

8. The work transfer device according to claim 1, further comprising:

a tilt mechanism for driving the work holder for rotation around a rotating shaft.

9. A work transfer device having a cross bar for supporting a work via a work holder for dismountably holding the work for transferring the work between adjoining pressing machines, the work transfer device comprising:

a beam provided between the pressing machines along the work transfer direction;

a feed carrier mounted on the beam and moved by a moving mechanism along the beam;

a lift carrier mounted on the feed carrier and driven up and down by a lifting mechanism; and a swinging body mounted on the lift carrier and driven for swinging along the work transfer direction by a swinging mechanism, wherein the cross bar is provided on the swinging body.

10. The work transfer device according to claim 9, further comprising:

a tilt mechanism for driving the cross bar for rotation around the longitudinal axis.

11. The work transfer device according to claim 9, wherein one unit of the beam is provided spanning between the adjoining pressing machines.

12. A work transfer device for transferring a work between adjoining pressing machines, comprising:

a work holder for holding the work;

a beam provided between the adjoining pressing machines along a work transfer direction;

a feed carrier mounted on the beam and moved by a moving mechanism along the beam;

a lift carrier mounted to the feed carrier to be moved up and down by a lifting mechanism;

a swinging body with an end attached to a swinging center shaft thereof provided on the lift carrier, the swinging body being driven for swinging by a swinging mechanism along the work transfer direction, wherein the work holder is provided on the other end of the swinging body, and wherein a lower dead point is present on a swinging trajectory against the swinging center shaft of the swinging body.

13. The work transfer device according to claim 12, wherein one unit of the swinging body is provided between the adjoining pressing machines.

* * * * *